US010967667B2

(12) United States Patent
Tani

(10) Patent No.: US 10,967,667 B2
(45) Date of Patent: Apr. 6, 2021

(54) FEEDING PENCIL

(71) Applicant: TOKIWA CORPORATION, Nakatsugawa (JP)

(72) Inventor: Yoshikazu Tani, Kawaguchi (JP)

( * ) Notice: Subject to any disclaimer, the term of this patent is extended or adjusted under 35 U.S.C. 154(b) by 114 days.

(21) Appl. No.: 16/423,039

(22) Filed: May 27, 2019

(65) Prior Publication Data

US 2019/0366755 A1 Dec. 5, 2019

(30) Foreign Application Priority Data

May 30, 2018 (JP) ..... JP2018-103250

(51) Int. Cl.

| | |
|---|---|
| ***B43K 21/08*** | (2006.01) |
| ***B43K 21/24*** | (2006.01) |
| ***B43K 21/00*** | (2006.01) |
| ***B43K 27/00*** | (2006.01) |

(52) U.S. Cl.

CPC ..... *B43K 21/08* (2013.01); *B43K 21/006* (2013.01); *B43K 21/24* (2013.01); *B43K 21/003* (2013.01); *B43K 27/006* (2013.01)

(58) Field of Classification Search

CPC .... B43K 21/00; B43K 21/003; B43K 21/006; B43K 21/02; B43K 21/027; B43K 21/18; B43K 21/24; B43K 27/00; B43K 27/006; B43K 27/02; B43K 27/08; B43K 2/12

USPC ..... 401/29, 30, 31, 32, 33, 88, 92, 93, 94

See application file for complete search history.

(56) References Cited

U.S. PATENT DOCUMENTS

| | | | | |
|---|---|---|---|---|
| 2,870,741 | A * | 1/1959 | Kersten | B43K 24/03 401/100 |
| 3,311,089 | A * | 3/1967 | Vogel | B43K 24/023 401/99 |
| 4,377,349 | A * | 3/1983 | Kunii | B43K 24/03 24/11 R |
| 6,464,419 | B1 * | 10/2002 | Chan | B43K 23/08 401/131 |
| 7,452,147 | B2 * | 11/2008 | Rolion | B43K 7/12 401/65 |
| 2017/0151824 | A1 | 6/2017 | Tani | |
| 2017/0151826 | A1 | 6/2017 | Tani | |

FOREIGN PATENT DOCUMENTS

| | | |
|---|---|---|
| JP | 2004-329775 | 11/2004 |
| JP | 2017-217497 | 12/2017 |
| KR | 10-2017-0063381 | 6/2017 |
| KR | 10-2018-0011296 | 1/2018 |

* cited by examiner

*Primary Examiner* — David J Walczak
(74) *Attorney, Agent, or Firm* — Soei Patent & Law Firm

(57) ABSTRACT

A feeding pencil includes a main body including a main body barrel having a tubular shape, a front barrel detachably engaged with the main body barrel, and a cartridge disposed in the front barrel to receive a drawing material. The cartridge includes a tubular portion provided on a rear side of the cartridge, the main body includes an insertion portion provided on a front side of the main body and configured to be engaged with the tubular portion. When the cartridge is tilted from the main body, an engagement between the tubular portion and the insertion portion is released.

16 Claims, 29 Drawing Sheets

FEEDING PENCIL

CROSS-REFERENCE TO RELATED APPLICATIONS

This application claims priority to Japanese Patent Application No. P2018-103250, filed May 30, 2018, the entire contents of which are incorporated herein by reference.

TECHNICAL FIELD

Feeding pencils with dischargeable drawing material.

BACKGROUND

Japanese Unexamined Patent Publication No. 2004-329775 discloses a cosmetic container including a cosmetic cartridge detachably provided therein. A female thread portion is formed on an inner peripheral surface of the storage container, and a male thread portion is formed on an outer peripheral surface of the cosmetic cartridge. A relative rotation between the storage container and the cosmetic cartridge in one direction causes the female thread portion of the storage container and the male thread portion of the cosmetic cartridge to engage with each other, thereby attaching the cosmetic cartridge to the storage container. On the other hand, when relative rotation between the storage container and the cosmetic cartridge in an opposite direction detaches the cosmetic cartridge from the storage container, the cosmetic cartridge is pulled out of the storage container.

SUMMARY

So that components in the feeding pencil can be readily attached and detached for replacement of the components of the cosmetic container, an operation of relative rotation between the storage container and the cosmetic cartridge may be used to detach the cosmetic cartridge from the storage container.

The feeding pencil should be configured to allow for components to be readily attached and detached.

An example feeding pencil may comprise a main body including a main body barrel having a tubular shape, a front barrel configured to be detachably engaged with the main body barrel, and a cartridge disposed in the front barrel and loaded with a drawing material. The cartridge includes a first engagement portion provided on a rear side of the cartridge, and the main body includes a second engagement portion provided on a front side of the main body and configured to be engaged with the first engagement portion. In some examples, when the cartridge is tilted from the main body, an engagement between the first engagement portion and the second engagement portion is released.

The engagement between the first engagement portion provided on the cartridge and the second engagement portion provided on the main body is released when the cartridge is tilted from the main body. This release of engagement allows the cartridge to detach from the main body. The example feeding pencil may be configured to allow the cartridge to readily detach from the main body by the operation of tilting the cartridge from the main body, rather than an operation of rotating the cartridge, for example. The detachment of the cartridge from the main body by tilting the cartridge can increase manufacturing efficiencies during assembly of the feeding pencil.

The main body may further include a slider provided in the main body barrel and which is slidable by a fixed amount relative to the main body barrel. In some examples, the slider may be disposed behind the cartridge, and the second engagement portion may be provided on a front side of the slider. When the cartridge is tilted from the slider with the front barrel detached from the main body barrel and the slider is moved forward by the fixed amount relative to the main body barrel, the engagement between the first engagement portion and the second engagement portion may be released. This configuration allows the cartridge to be readily detached with the front barrel detached from the main body barrel and the slider moved forward by the fixed amount.

In some examples, the front barrel may be engaged with the main body barrel and may be rotatable relative to the main body barrel. The cartridge may include a pipe member loaded with the drawing material, a mobile body configured to push out the drawing material loaded in the pipe member forward, and a holder configured to hold the mobile body behind the pipe member. Additionally, the slider may be moved forward by the fixed amount relative to the main body barrel to cause the pipe member to engage with the front barrel in a rotational direction, and a relative rotation between the front barrel and the main body barrel in one direction with the pipe member engaged with the front barrel in the rotational direction may cause the drawing material to move forward in the front barrel. When the slider is moved forward by the fixed amount relative to the main body barrel, the pipe member is moved forward accordingly. Then, with the pipe member engaged with the front barrel in the rotational direction, the relative rotation between the front barrel and the main body barrel in the one direction causes the drawing material to move forward. In some examples, a structure in which the drawing material is moved forward by the relative rotation between the front barrel and the main body barrel may exhibit substantially the same effects as the described above.

Either one of the first engagement portion and the second engagement portion may include a cutout hole formed through a tubular portion, and the other engagement portion may include an insertion portion that is configured to be inserted into and engaged with the cutout hole. The insertion portion and the cutout hole allow the engagement between the first engagement portion and the second engagement portion to be readily made.

In some examples, the first engagement portion may be the tubular portion, and the second engagement portion may be the insertion portion. When the second engagement portion of the main body is the tubular portion having the cutout hole, the cartridge is detached from the main body by being tilted from the main body, which may decrease the mechanical strength of the second engagement portion of the main body due to repeated attachment and detachment. This in turn may decrease the strength of the engagement between the first engagement portion and the second engagement portion, or the integrity of the second engagement portion may be compromised. On the other hand, when the first engagement portion of the cartridge is the tubular portion having the cutout hole, the mechanical strength of the second engagement portion after repeated attachment and detachment may be maintained.

In some examples, when the cartridge is tilted from the main body to cause the tubular portion to separate from the insertion portion while causing the insertion portion to expand the tubular portion, the cartridge may be detached from the main body. This configuration allows the insertion portion to expand the cutout hole of the tubular portion. Therefore, when the cartridge is tilted from the main body, the tubular portion is expanded by the insertion portion. This expansion causes the tubular portion to separate from the insertion portion and accordingly causes the cartridge to detach from the main body.

In some examples, the insertion portion may have a cylindrical shape. This configuration allows the tubular portion to be less liable to be caught in the insertion portion when the cartridge is detached from the main body by being tilted from the main body, allowing the cartridge to readily detached.

A projection may be formed on an outer surface of the insertion portion, and a raised portion may be formed on an inner wall surface of the cutout hole, the projection being engaged with the raised portion. Additionally, the projection and the raised portion may be provided on opposite sides of the tubular portion from each other in a radial direction of the tubular portion. This configuration allows the cartridge to detach from the main body by being tilted to not only one side in the radial direction but also the other side opposite to the one side. This in turn allows the cartridge to be readily detached from the main body.

According to the examples described herein, various components of the feeding pencil can be readily attached and detached.

DETAILED DESCRIPTION

Figure 1:
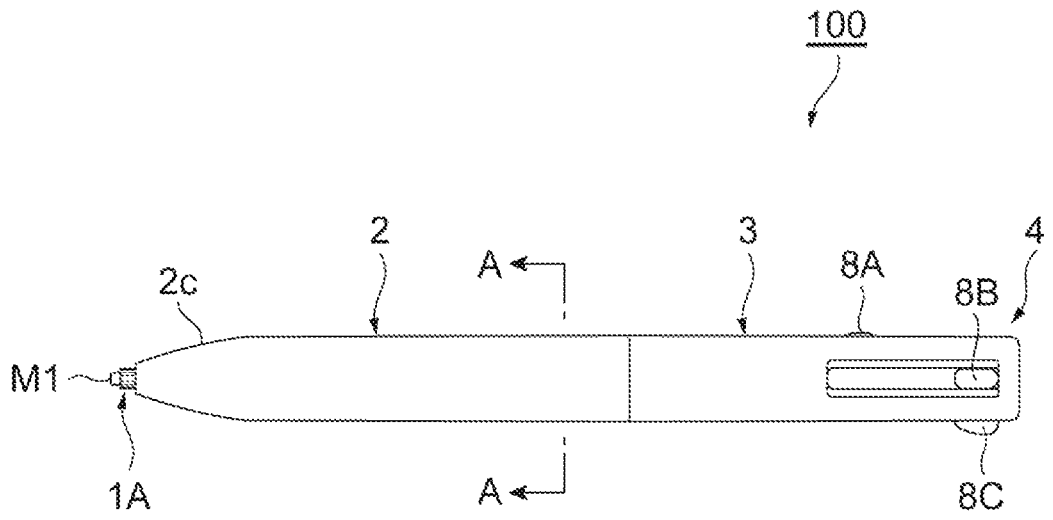
FIG. 1 is a side view of an example feeding pencil.

Hereinafter, various examples will be described with reference to the drawings. In the following description, the same or equivalent components are denoted by the same reference numerals, and any redundant description will be omitted as appropriate.

Figure 2:
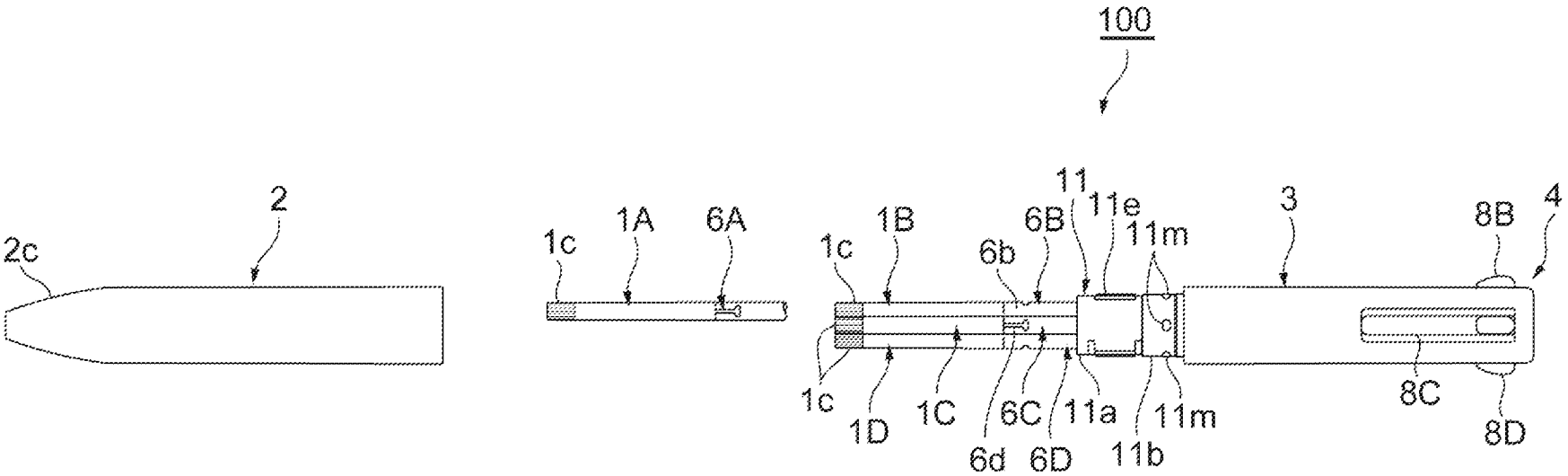
FIG. 2 is a side view of the feeding pencil illustrated in FIG. 1, where one cartridge has been removed.
Figure 3:
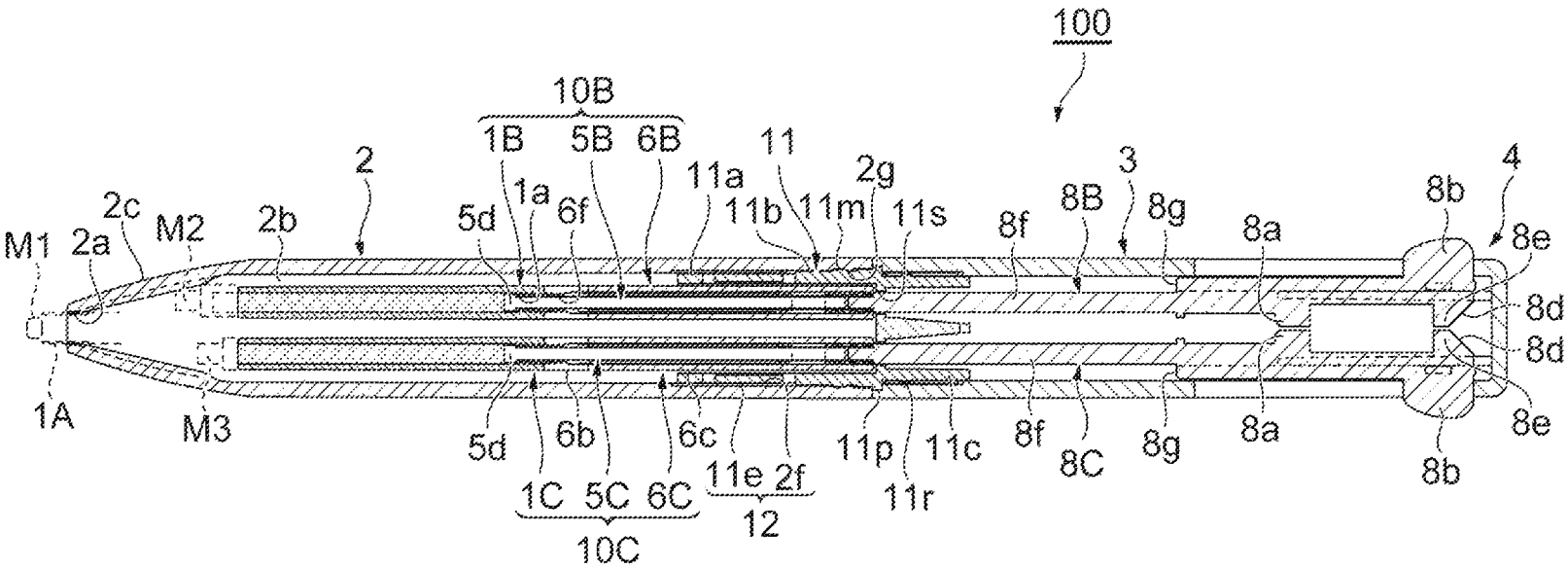
FIG. 3 is a longitudinal cross-sectional view of the feeding pencil illustrated in FIG. 1.

FIG. 1 is a side view of an example feeding pencil. FIG. 2 is a side view of the feeding pencil illustrated in FIG. 1, showing a state where one cartridge is taken out of the feeding pencil. FIG. 3 is a longitudinal cross-sectional view of the feeding pencil illustrated in FIG. 1. As illustrated in FIG. 1 to FIG. 3, the feeding pencil 100 may include a multi-color pencil configured to discharge (i.e. push out), in response to an operation made by a user, any one of a plurality of drawing materials M1 to M4 loaded in respective four pipe members 1A to 1D. In some examples, the drawing materials M1 to M4 refer to drawing materials having mutually different colors.

The drawing materials M1 to M4 may include various rod-shaped cosmetics such as lipstick, lip gloss, eyeliner, eyebrow, lip liner, blush, concealer, beauty stick, hair dye, and nail art, a stationery rod-shaped core, or the like. Furthermore, one or more of the drawing materials M1 to M4 may include a flexible (e.g. semi-solid, soft-solid, soft, jelly, mousse, paste containing these, or the like) rod-shaped object. In some examples, one or more of the drawing materials M1 to M may include a narrow rod-shaped object having an outer diameter of 1 mm or less, a general rod-shaped object having an outer diameter of 1.5 mm to 3.0 mm, or a thick rod-shaped object having an outer diameter of 4.0 mm or more.

The feeding pencil 100 may include a front barrel 2 including the pipe members 1A to 1D loaded with the drawing materials M1 to M4, and a main body 4 including a main body barrel 3 that is connected to a rear end portion of the front barrel 2 and is engaged with the front barrel 2 in such a way as to be rotatable relative to the front barrel 2, as outer members. In one or more of the examples, an "axis" may be understood to refer to a center line of the feeding pencil 100 extending in a longitudinal direction of the feeding pencil 100, and an "axial direction" may be understood to refer to a direction along the axis, that is, the longitudinal direction. Additionally, a "front side" may be understood to refer to a side from the main body 4 toward the front barrel 2 in the axial direction, and a "rear side" may be understood to refer to a side from the front barrel 2 toward the main body 4 in the axial direction. A "front end" may be understood to refer to an end on the front side of a certain component, and a "rear end" may be understood to refer to an end on the rear side of a certain component. Still further, "radial direction" may be understood to refer to a direction orthogonal to the axis, and a "circumferential direction" may be understood to refer to a direction along a ring centered on the axis. In some examples, it may be assumed that a feeding direction of the drawing materials M1 to M4 refers to a front (i.e. forward direction), and a direction opposite to the feeding direction refers to a rear (i.e. rearward direction).

As illustrated in FIG. 3, a mobile body 5B having a rod shape is screwed into the pipe member 1B and is held by a holder 6B having a tubular shape. The pipe member 1B, the mobile body 5B, and the holder 6B constitute a cartridge 10B replaceable with respect to the main body 4. The pipe member 1C may have the same configuration as the pipe member 1B has, and the pipe member 1C, a mobile body 5C, and a holder 6C constitute a cartridge 10C. The same applies to the pipe members 1A and 1D.

A slider 8B configured to be engaged with the holder 6B in the axial direction, and a spring 9B (see FIG. 4 and FIG. 5) configured to energize the slider 8B rearward, may be located behind the cartridge 10B. Similarly, a slider 8C and a spring 9C may be located behind the cartridge 10C, and a slider 8A and a spring 9A may be located behind the cartridge 10A. Additionally, a slider and a spring may be located behind a cartridge constituted by the pipe member 1D.

Figure 4:
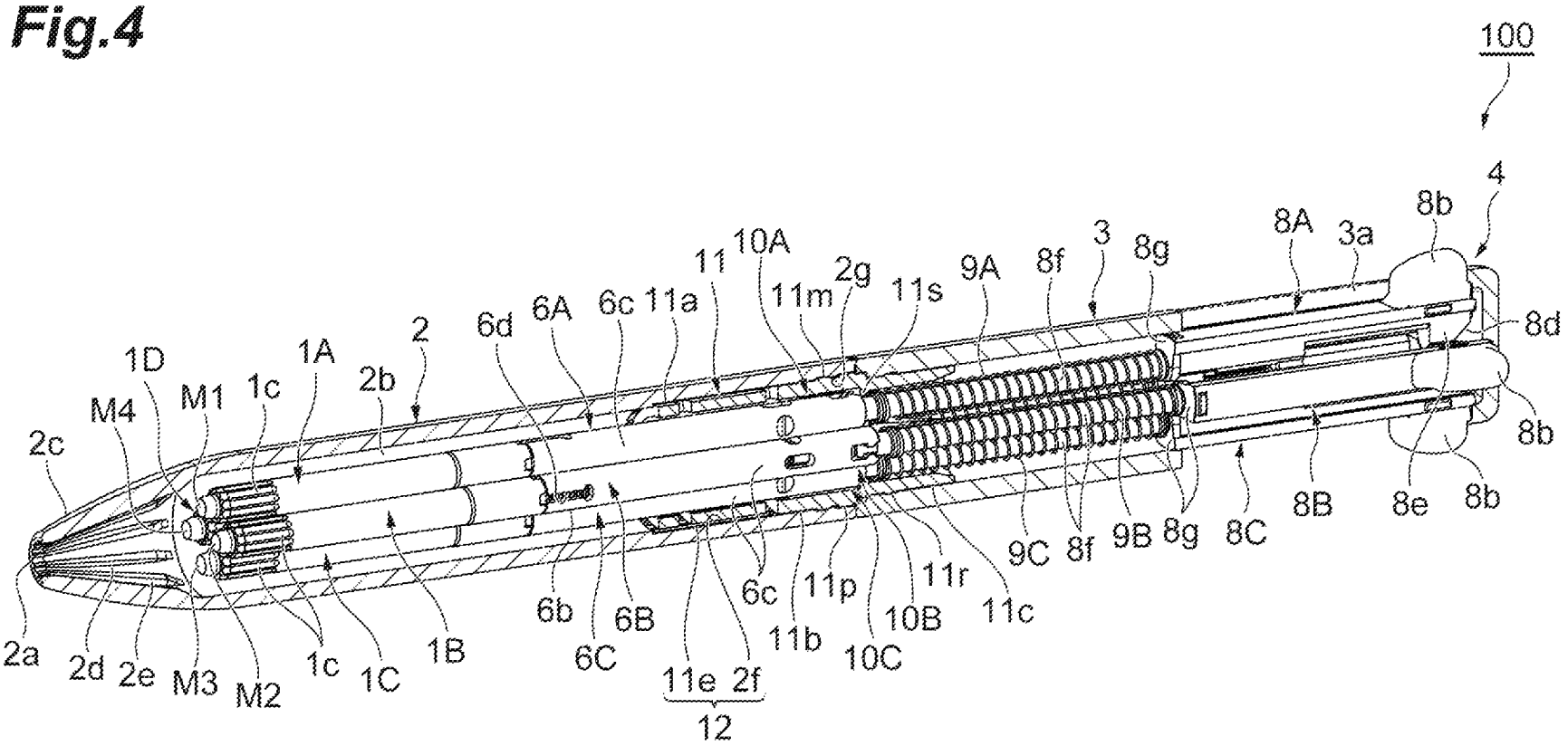
FIG. 4 is a perspective cross-sectional view of the feeding pencil illustrated in FIG. 1.
Figure 5:
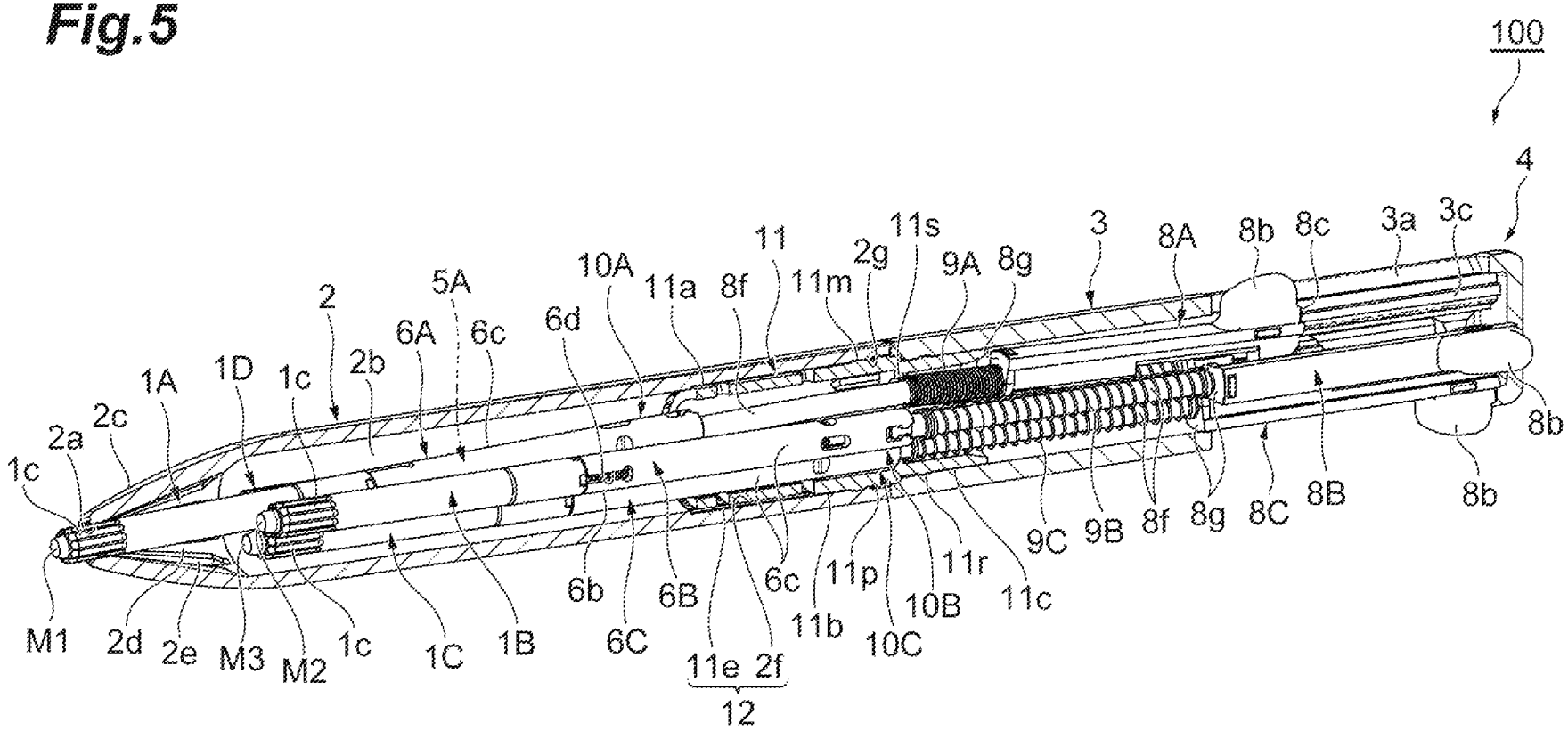
FIG. 5 is a perspective cross-sectional view of the feeding pencil illustrated in FIG. 4, where one slider is moved forward.

FIG. 4 is a perspective cross-sectional view of the example feeding pencil 100 illustrated in FIG. 1. FIG. 5 is a perspective cross-sectional view of the feeding pencil 100 of FIG. 4, showing a state where one slider 8A is moved forward. As illustrated in FIG. 4 and FIG. 5, the main body 4 includes four sliders such as the slider 8A provided therein and four springs such as the spring 9A each provided on a corresponding one of the four sliders. Inside the front barrel 2 are four pipe members 1A to 1D loaded respectively with the drawing materials M1 to M4, four mobile bodies such as the mobile body 5A, and four holders such as the holder 6A. The four pipe members, the four mobile bodies, the four holders, the four springs, and the four sliders mutually may have the same configuration except that different drawing materials M1 to M4 are loaded in each pipe member.

The four pipe members, the four mobile bodies, the four holders, the four springs, and the four sliders may be referred to as a pipe member 1, a mobile body 5, a holder 6, a spring 9, and a slider 8, respectively. Further, the four cartridges such as the cartridge 10A and the drawing materials M1 to M4 may be referred to as a cartridge 10 and a drawing material M, respectively.

A middle barrel 11 is engaged with a front end of the main body barrel 3 in such a way as to be synchronously rotatable with the main body barrel 3, and the middle barrel 11 has four holders 6 held therein. Further, the middle barrel 11 and the front barrel 2 are provided with a ratchet mechanism 12 that may be configured to restrict the relative rotation between the front barrel 2 and the main body barrel 3 (e.g. the middle barrel 11) in one direction. For examples, the ratchet mechanism 12 may be configured to prohibit the relative rotation between the front barrel 2 and the main body barrel 3 in the opposite direction.

Figure 6:
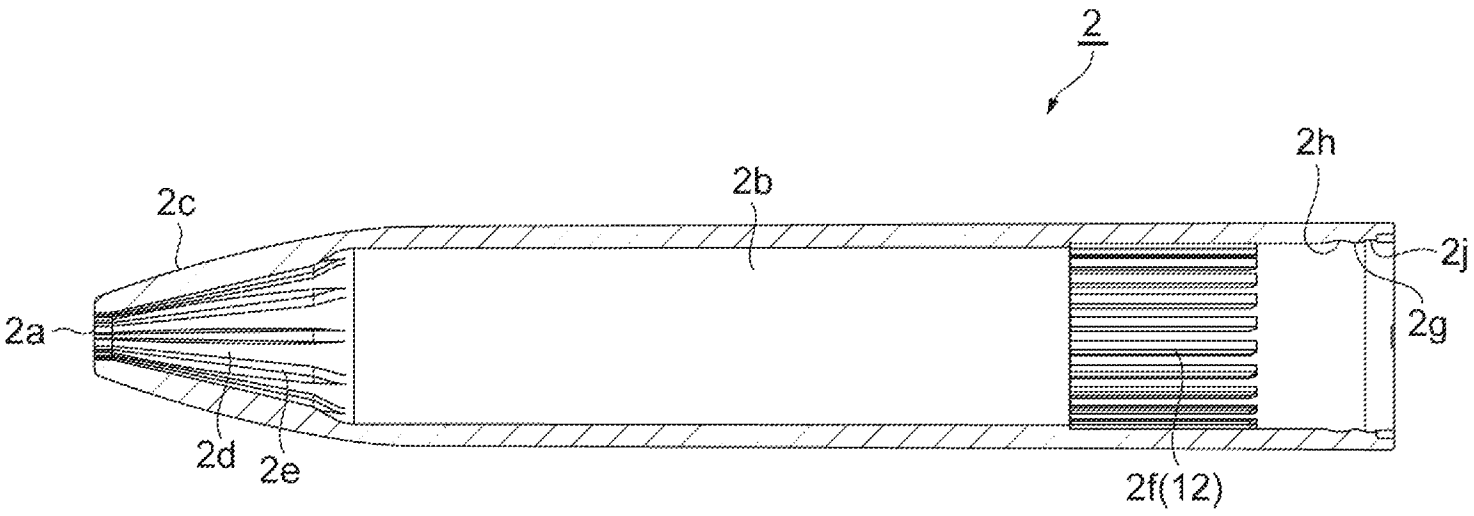
FIG. 6 is a longitudinal cross-sectional view of a front barrel.

FIG. 6 is a longitudinal cross-sectional view of the front barrel 2. As illustrated in FIG. 6, the front barrel 2 may be formed of an ABS resin (i.e. a copolymer synthetic resin of Acrylonitrile Butadiene Styrene), may have a tubular shape. The front barrel 2 may include an opening 2*a* at the front end thereof. The opening 2*a* allows a front portion of the pipe member 1 to come out. Located inside the front barrel 2 is a storage area 2*b* for storing four cartridges 10, and any one of the four pipe members 1 provided in the storage area 2*b* is exposed forward from the opening 2*a* in response to the operation made by the user.

Located on a front side of an outer peripheral surface of the front barrel 2 is an inclined surface 2*c* that is gradually tapered forward. An inner peripheral surface 2*d* on the front side of the front barrel 2 is also tapered forward. Located on the inner peripheral surface 2*d* are ridges 2*e* configured to be engaged with the pipe member 1 in a rotational direction (i.e. a direction around the axis). In some examples, the ridges 2*e* are constituted by a number of raised portions arranged in the circumferential direction and extending in an inclination direction of the inner peripheral surface 2*d*. The ridges 2*e* extend across an entire area from one end to the other end in the inclination direction. Further, a space between the ridges 2*e* in the circumferential direction narrows toward the front side.

Located on a rear side of the inner peripheral surface of the front barrel 2, and provided as a component of the ratchet mechanism 12, is a raised and recessed portion 2*f* constituted by 24 raised and recessed portions arranged in the circumferential direction and extending in the axial direction by a predetermined length. Located behind the raised and recessed portion 2*f* on the inner peripheral surface of the front barrel 2 are an annular raised portion 2*g* configured to cause the middle barrel 11 to engage with a rear side of the front barrel 2 in the axial direction, an annular recessed portion 2*h* located in front of the annular raised portion 2*g*, and an annular recessed portion 2*j* located behind the annular raised portion 2*g*.

Figure 7A:
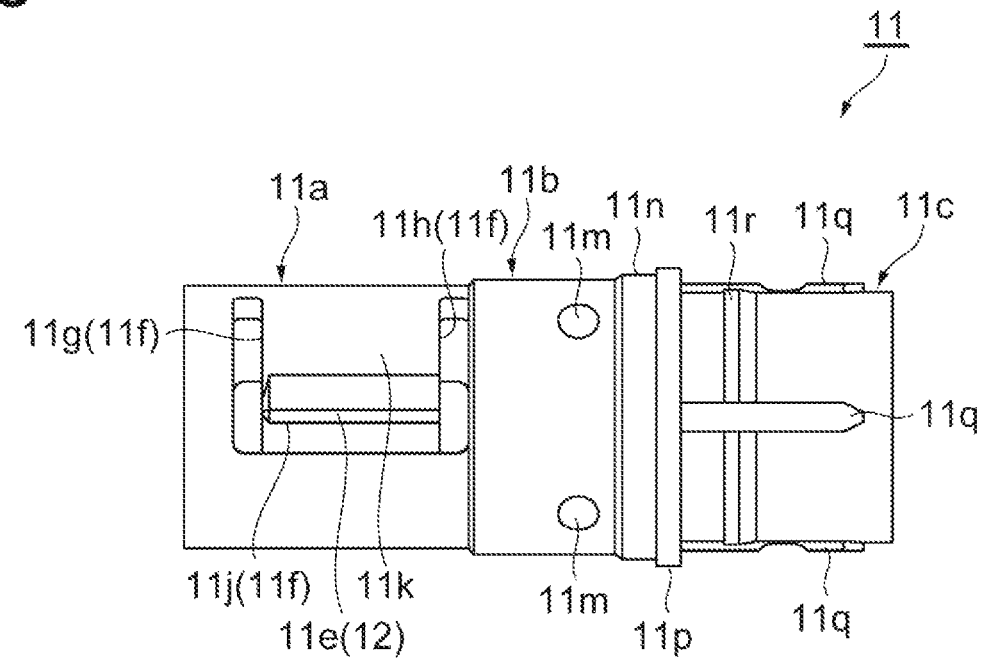
FIG. 7A is a side view of a middle barrel.
Figure 7B:
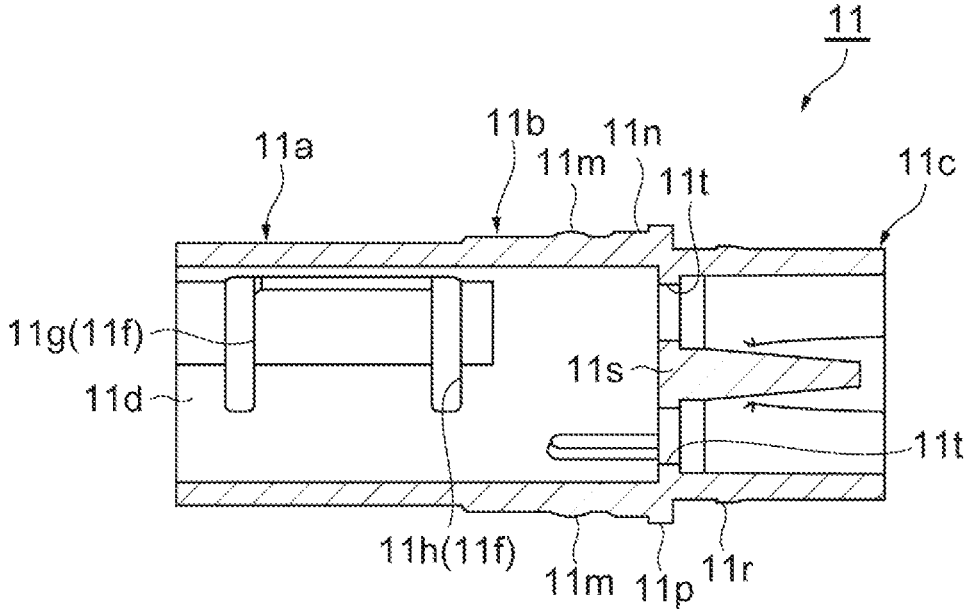
FIG. 7B is a longitudinal cross-sectional view of the middle barrel.

FIG. 7A is a side view of the middle barrel 11, and FIG. 7B is a longitudinal cross-sectional view of the middle barrel 11. The middle barrel 11 is an injection-molded product made of polyacetal (polyoxymethylene; POM) and has a stepped tubular outer shape. The middle barrel 11 includes a front barrel portion 11*a*, a central barrel portion 11*b* larger in outer diameter than the front barrel portion 11*a*, and a rear barrel portion 11*c* smaller in outer diameter than the front barrel portion 11*a* and the central barrel portion 11*b*, and arranged in this order from the front to the rear.

The front barrel portion 11*a* includes elastic or springy projections 11*e* that are located on opposite sides of the front barrel portion 11*a* from each other on an inner peripheral surface 11*d* and that constitute the other component of the ratchet mechanism 12. The elastic projection 11*e* may be configured to engage with the raised and recessed portion 2*f* of the front barrel 2 in the rotational direction and is provided in such a way as to project outward in the radial direction. Formed around the elastic projection 11*e* of the front barrel portion 11*a* is a cutout 11*f* that has a U-shape and that causes the inside and the outside of the middle barrel 11 to communicate with each other. The cutout 11*f* makes the elastic projection 11*e* springy in the radial direction. The elastic projection 11*e* of the middle barrel 11 may remain in continuous contact with the raised and recessed portion 2*f* of the front barrel 2.

Figure 8:
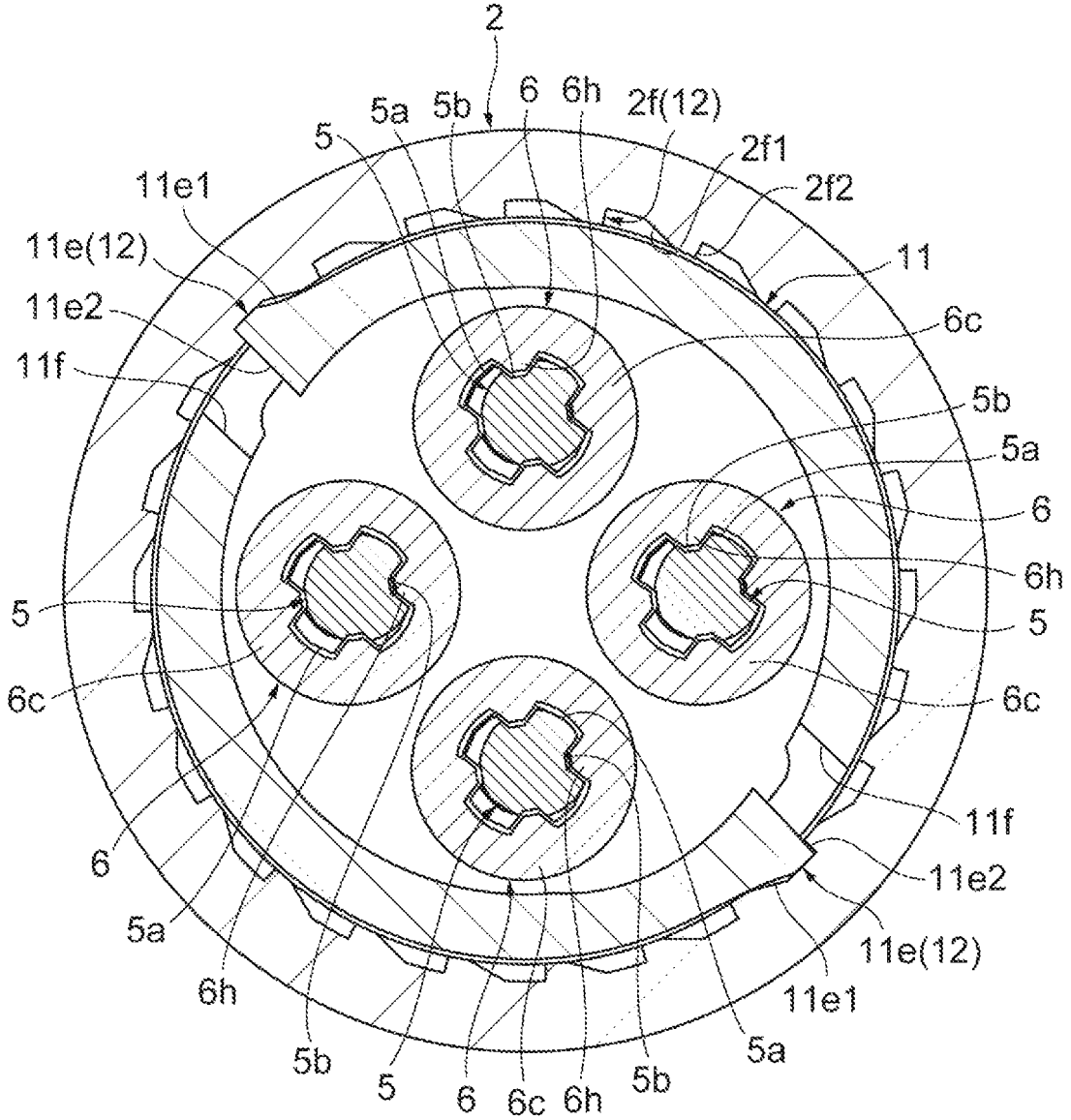
FIG. 8 is a cross-sectional view taken along line A-A of FIG. 1.

FIG. 8 is a cross-sectional view taken along line A-A of FIG. 1. As illustrated in FIG. 8, the raised and recessed portion 2*f* of the front barrel 2 constituting one component of the ratchet mechanism 12 includes an inclined surface 2*f*1 inclined relative to the inner peripheral surface of the front barrel 2, and a side surface 2*f*2 formed substantially perpendicular to the inner peripheral surface of the front barrel 2. Further, the elastic projection 11*e* of the middle barrel 11 constituting the other component of the ratchet mechanism 12 includes an inclined surface 11*e*1 inclined relative to an outer peripheral surface of the middle barrel 11, and a side surface 11*e*2 formed substantially perpendicular to a tangent line to the outer peripheral surface of the middle barrel 11.

Referring again to FIG. 7A and FIG. 7B. The cutout 11*f* of the middle barrel 11 includes a pair of slits 11*g* and 11*h* made on both sides in the axial direction of the elastic projection 11*e* of the front barrel portion 11*a* and that extend in the circumferential direction. Additionally, the cutout 11*f* may include a slit 11*j* made on one side in the circumferential direction of the elastic projection 11*e* of the front barrel portion 11*a* and that extends contiguously to the slits 11*g* and 11*h* in the axial direction. One or more of the slits may comprise holes. A wall portion surrounded by the cutout 11*f* of the front barrel portion 11*a* serves as an arm 11*k* having flexibility in the radial direction. Accordingly, the elastic projection 11*e* disposed on an outer surface of an end of the arm 11*k* has springy force (e.g. energizing force or elastic force) in the radial direction.

Located on an outer peripheral surface of the central barrel portion 11*b* of the middle barrel 11 are a projection 11*m* configured to be detachably engaged with the annular raised portion 2*g* of the front barrel 2, an annular raised portion 11*n* configured to be inserted into the annular recessed portion 2*j* of the front barrel 2 from the rear, and a flange portion 11*p* located on the rear side of the annular raised portion 11*n*. A barrel portion of the middle barrel 11 located in front of the flange portion 11*p* is inserted into the front barrel 2 from the rear.

Formed on the rear barrel portion 11*c* of the middle barrel 11 is a ridge 11*q* configured to be engaged with the main body barrel 3 in the rotational direction and extending in the axial direction. The ridge 11*q* is formed at four positions equally distanced from each other in the circumferential direction on the outer peripheral surface of the rear barrel portion 11*c*. Located behind the flange portion 11*p* is a raised portion 11*r* configured to be engaged with the main body barrel 3 in the axial direction and extending in the circumferential direction between the ridges 11*q*.

As illustrated in FIG. 7B, the middle barrel 11 is partitioned by a holder accommodating portion 11*s* through which the four sliders 8 are inserted in the axial direction on the inner surface side of the flange portion 11*p*. Located at each of four positions equally distanced from each other in the circumferential direction of the holder accommodating portion 11*s* is an opening lit that has a circular shape and that allows the slider 8 to be inserted therethrough in the axial direction.

The front barrel portion 11*a* and the central barrel portion 11*b* of the middle barrel 11 are inserted into the front barrel 2 from the rear side. In this configuration, the elastic projection 11*e* of the front barrel portion 11*a* is engaged with the raised and recessed portion 2*f* of the front barrel 2 in the rotational direction, the projection 11*m* of the central barrel portion 11*b* is engaged with the annular raised portion 2*g* of the front barrel 2 and then fitted into the annular recessed portion 2*h*, and then the annular raised portion 11*n* of the central barrel portion 11*b* enters the annular recessed portion 2*j* of the front barrel 2.

Figure 9A:
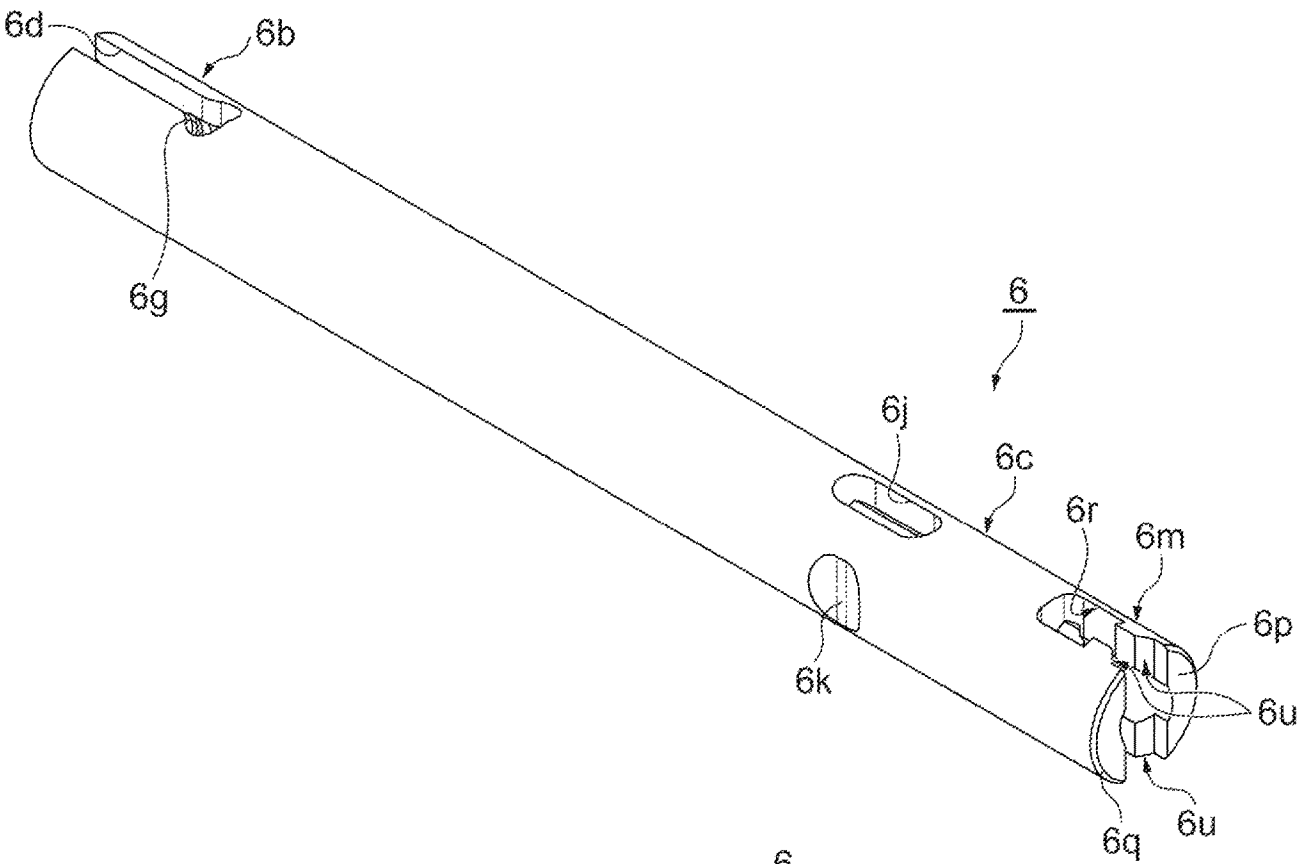
FIG. 9A is a perspective view of a holder.
Figure 9B:
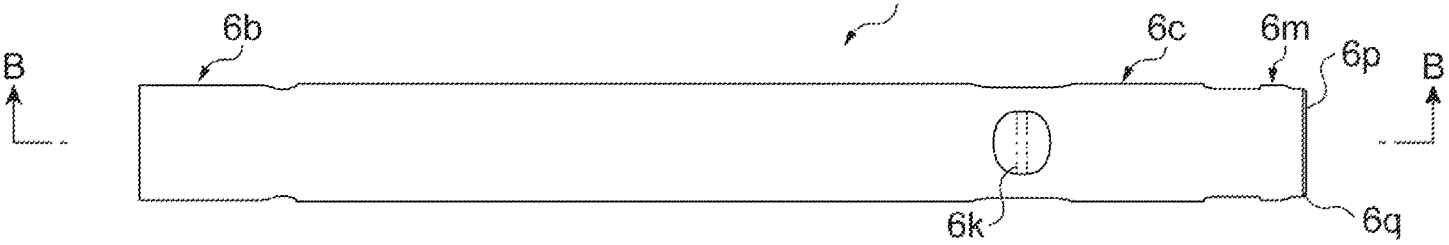
FIG. 9B is a side view of the holder illustrated in FIG. 9A.
Figure 10A:
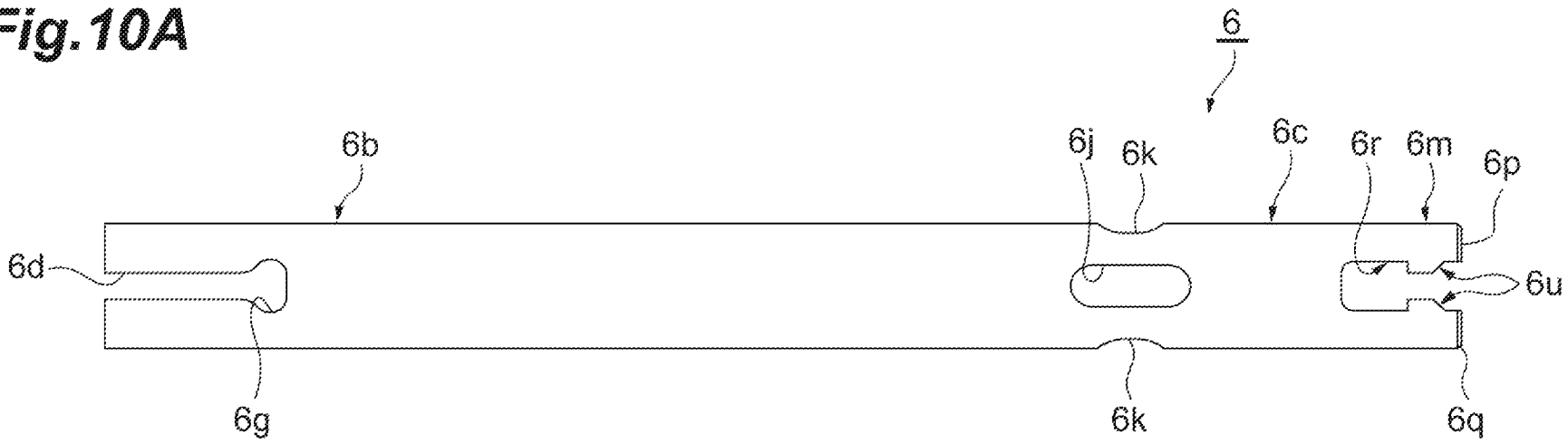
FIG. 10A is a side view of the holder illustrated in FIG. 9A as viewed from a direction different from the direction of FIG. 9B.
Figure 10B:
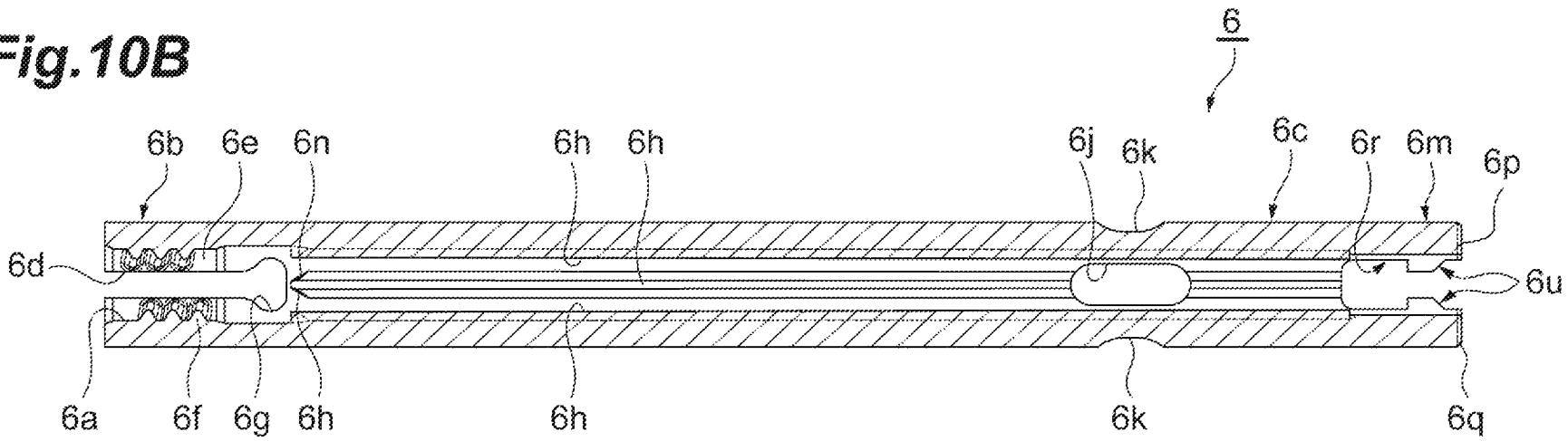
FIG. 10B is a cross-sectional view taken along line B-B of FIG. 9B.

FIG. 9A is a perspective view of the holder 6, and FIG. 9B is a side view of the holder 6. FIG. 10A is a side view of the holder 6 as viewed from a direction different from the direction of FIG. 9B, and FIG. 10B is a cross-sectional view taken along line B-B of FIG. 9B. The holder 6 has a tubular shape as a whole. An example material of the holder 6 includes POM (polyoxymethylene). The holder 6 includes a mobile body pressing portion 6*b* configured to press the mobile body 5, and a tubular portion 6*c* that has a tubular shape and extends rearward from the mobile body pressing portion 6*b*. The mobile body pressing portion 6*b* includes a hole 6*a* provided on the front side of the holder 6 for accommodating the mobile body 5.

The mobile body pressing portion 6*b* of the holder 6 includes a pair of slits 6*d* that extend rearward from a front end thereof by a predetermined length and that oppose each other in the mobile body pressing portion 6*b*. In the mobile body pressing portion 6*b* including the slits 6*d*, the mobile body 5 is tightened inward in the radial direction by elasticity of the resin of the holder 6. The slits 6*d* allow the mobile body pressing portion 6*b* to be increased in diameter.

Located at a rear end of each of the slits 6*d* is an expanded portion 6*g* which appears to expand when viewed from the radial direction. The elasticity of the mobile body pressing portion 6*b* for tightening the mobile body 5 may be selectively adjusted by the expanded portion 6*g*. Located on an inner surface 6*e* of the mobile body pressing portion 6*b* is a projection 6*f* having a spiral shape. The projection 6*f* is disposed at three positions in the axial direction on the inner surface 6*e* of the holder 6. The projection 6*f* comes into contact with a male thread 5*a* (see FIGS. 13A and 13B) of the mobile body 5 from the outer side in the radial direction. Further, the mobile body 5 may be configured to be engaged with and/or to be detachably held in the holder 6, via the projection 6*f*.

Located in the tubular portion 6*c* of the holder 6 are four ridges 6*h* arranged at four positions equally distanced from each other in the circumferential direction and extending in the axial direction. The ridges 6*h* may be configured to prevent the mobile body 5 from rotating relative to the holder 6. Each of the ridges 6*h* includes a tapered surface 6*n* tapered toward the front end thereof, and. Due to the tapered surface 6*n*, the ridge 6*h* has a shape that allows the mobile body 5 to be readily inserted from the front side.

In a cross-sectional view of the tubular portion 6*c* taken along a plane orthogonal to the axial direction, an internal space of the tubular portion 6*c* has a noncircular shape (e.g. cross shape) due to the ridges 6*h* (see FIG. 8). Located in the tubular portion 6*c*, as a support portion that supports a core pin in such a way as to prevent the core pin from being tilted by pressure generated at injection molding, is a through hole 6*j* that has an elliptic shape, extends in the axial direction, and passes through the holder 6 from the inside to the outside.

Through holes 6*j* are formed on opposite sides of the tubular portion 6*c* from each other in the radial direction in the tubular portion 6*c*. The through hole 6*j* is provided on the rear side of the tubular portion 6*c* and at the same position as the slit 6*d* is located as viewed from the axial direction. A recessed portion 6*k* is recessed inward in the radial direction from the outer peripheral surface of the tubular portion 6*c*. The recessed portion 6*k* is a gate mark generated in the injection molding and has a circular shape extending in the circumferential direction. Recessed portions 6*k* are located on opposite sides of the tubular portion 6*c* from each other in the radial direction and are located between a pair of the through holes 6*j*.

Figure 11A:
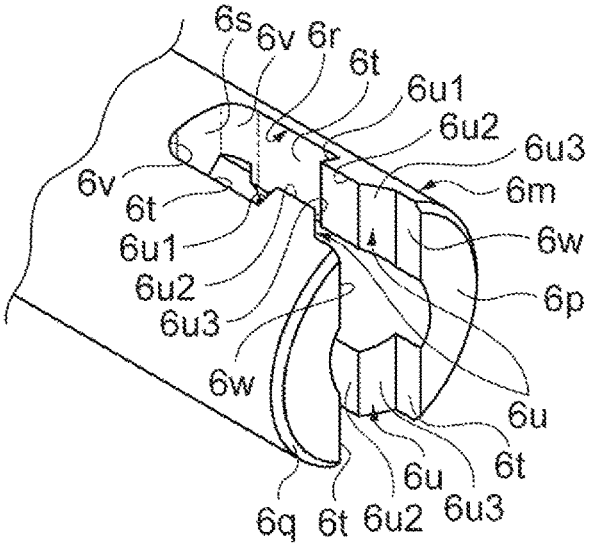
FIG. 11A is an enlarged perspective view of a portion around a rear end of the holder illustrated in FIG. 9A.
Figure 11B:
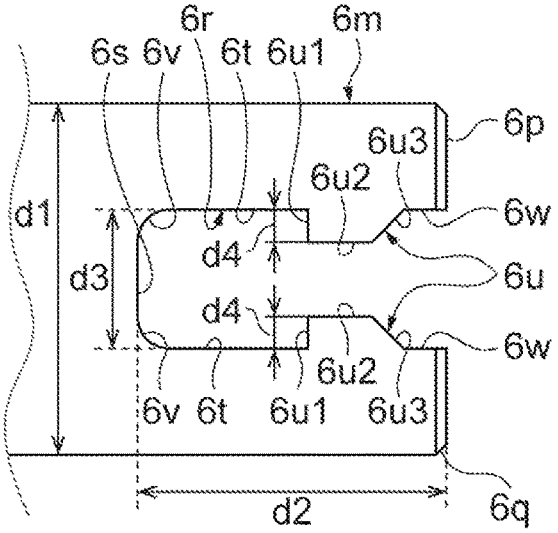
FIG. 11B is a side view of the portion around the rear end of the holder illustrated in FIG. 11A.
Figure 11C:
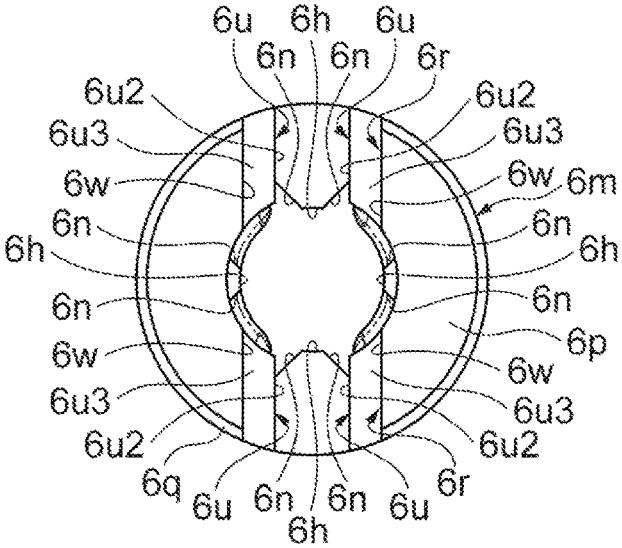
FIG. 11C is a rear view of the holder as viewed from the rear end of the holder.

FIG. 11A is an enlarged perspective view of a rear end of the holder 6, FIG. 11B is a side view of the rear end of the holder 6, and FIG. 11C is a rear view of the holder 6 as viewed from the rear end of the holder 6. Located at the rear end of the holder 6 is a tubular portion 6*m* (first engagement portion) that has a tubular shape and extends contiguously from the tubular portion 6*c* to the rear end of the holder 6 in the axial direction. An outer diameter d1 of the tubular portion 6*m* is, for example, 3.3 mm.

The tubular portion 6*m* includes a rear end surface 6*p* located at the rear end of the holder 6, and an inclined surface 6*q* formed along a periphery of the rear end surface 6*p* and inclined forward from the rear end surface 6*p*. The rear end surface 6*p* is a flat surface extending in the radial direction and the circumferential direction. The inclined surface 6*q* is inclined outward in the radial direction while extending forward. Located in the tubular portion 6*m* is a slit 6*r* (cutout hole) extending by a predetermined length forward from the rear end surface 6*p*.

Slits 6*r* are formed at opposite sides of the tubular portion 6*m* in the radial direction. The slit 6*r* is provided, for example, at the same position as the slit 6*d* and the through hole 6*j* are located as viewed from the axial direction. The slit 6*r* thus formed allows the tubular portion 6*m* to be expanded outward (flared) in the radial direction. The slit 6*r* has a rectangular shape extending in the axial direction.

The slit 6*r* includes an inner wall surface 6*s* located at the front end thereof, and a pair of inner wall surfaces 6*t* provided behind the inner wall surface 6*s* and located on opposite sides from each other in the circumferential direction. Additionally, the slit 6*r* includes a pair of raised portions 6*u* each projecting from a rear side of a corresponding one of the pair of inner wall surfaces 6*t* in the circumferential direction, and a pair of inner wall surfaces 6*w* each provided between a corresponding one of the pair of raised portions 6*u* and the rear end surface 6*p*. The inner wall surface 6*s* extends in the radial direction and the circumferential direction, for example, along the rear end surface 6*p*. A distance d2 between the inner wall surface 6*s* and the rear end surface 6*p* in the axial direction (i.e. a length of the slit 6*r* in the axial direction) is, for example, 2.9 mm. The distance d2 is in a range of, for example, 70% to 120% of the outer diameter d1 of the tubular portion 6*m*.

Each of the pair of inner wall surfaces 6*t* extends in the axial direction and the radial direction. Each of the pair of inner wall surfaces 6*t* is substantially perpendicular to the inner wall surface 6*s* and the rear end surface 6*p*. A distance d3 between the pair of inner wall surfaces 6*t* (i.e. a width of the slit 6*r*) is, for example, 1.3 mm. The distance d3 is in a range of, for example, 20% to 60% of the outer diameter d1 of the tubular portion 6*m*. Located at a connecting portion between each of the inner wall surfaces 6*t* and the inner wall surface 6*s*, that is, at each corner portion of the front end of the slit 6*r*, is a curved surface 6*v* extending in a curved form in the axial direction and the circumferential direction. The curved surface 6*v* may be configured to reduce concentration of stress on a corresponding corner of the slit 6*r* when the tubular portion 6*m* is expanded.

The pair of inner wall surfaces 6*w* oppose each other in the circumferential direction. Each of the inner wall surfaces 6*w* extends along a corresponding one of the inner wall surfaces 6*t*. A distance between the pair of inner wall surfaces 6*w* is, for example, the same as a distance between the pair of inner wall surfaces 6*t*, and each of the inner wall surfaces 6*w* may be located at the same position as a corresponding one of the inner wall surfaces 6*t*, when viewed from the axial direction. The pair of raised portions 6*u* are provided on the rear side of the slit 6*r*. The raised portions 6*u* are located on opposite sides from each other in the circumferential direction and symmetrical in the circumferential direction. Each of the raised portions 6*u* has a rectangular shape as viewed from the radial direction.

Each of the raised portions 6*u* includes a front end surface 6*u*1 located at the front end thereof, a top surface 6*u*2 extending rearward from the front end surface 6*u*1, and a tapered surface 6*u*3 contiguously extending to the top surface 6*u*2 and the inner wall surface 6*w* and inclined relative to the top surface 6*u*2 and the inner wall surface 6*w*. The front end surface 6*u*1 is a flat surface along the radial direction and the circumferential direction and is formed substantially perpendicular to the inner wall surface 6*t*. The front end surface 6*u*1 and the inner wall surface 6*s* oppose each other in the axial direction and are separated from each other by a predetermined distance.

The top surface 6*u*2 is located closer to a center of the slit 6*r* than the inner wall surface 6*t*, in a width direction of the slit 6*r*. The top surface 6*u*2 extends along the inner wall surface 6*t*, and in some examples, extends parallel to the inner wall surface 6*t*. The top surface 6*u*2 is formed substantially perpendicular to the front end surface 6*u*1. A distance d4 between the top surface 6*u*2 and the inner wall surface 6*t* (i.e. a height of the raised portion 6*u* from the inner wall surface 6*t*) is, for example, 0.3 mm. The distance d4 is in a range of, for example, 5% to 20% of the outer diameter d1 of the tubular portion 6*m*.

The tapered surface 6*u*3 is inclined in such a way as to be flared rearward. In some examples, the pair of tapered surfaces 6*u*3 are inclined rearward in such a way as to spread apart from each other. The projection 8*m* (see FIG. 15) of the slider 8 (to be described later) may be readily inserted into the slit 6*r* from the rear due to the tapered surface 6*u*3 of the slit 6*r*.

Figure 12A:
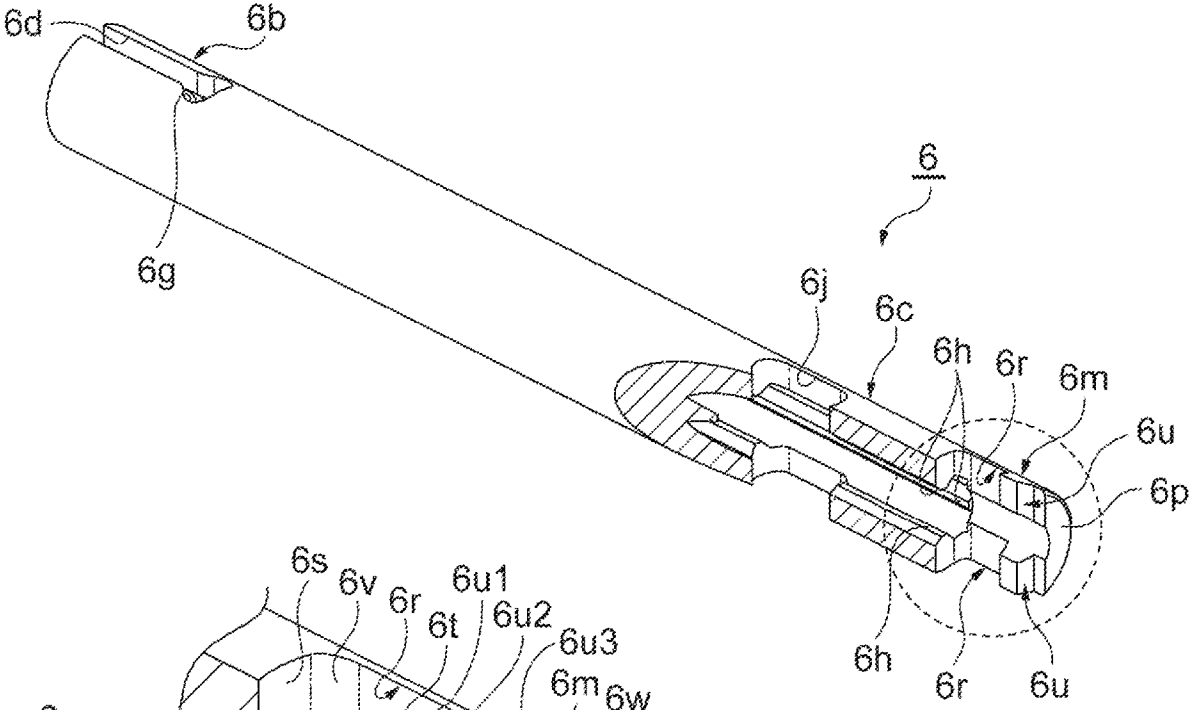
FIG. 12A is a perspective, partial cross-sectional view of the holder illustrated in FIG. 9A.
Figure 12B:
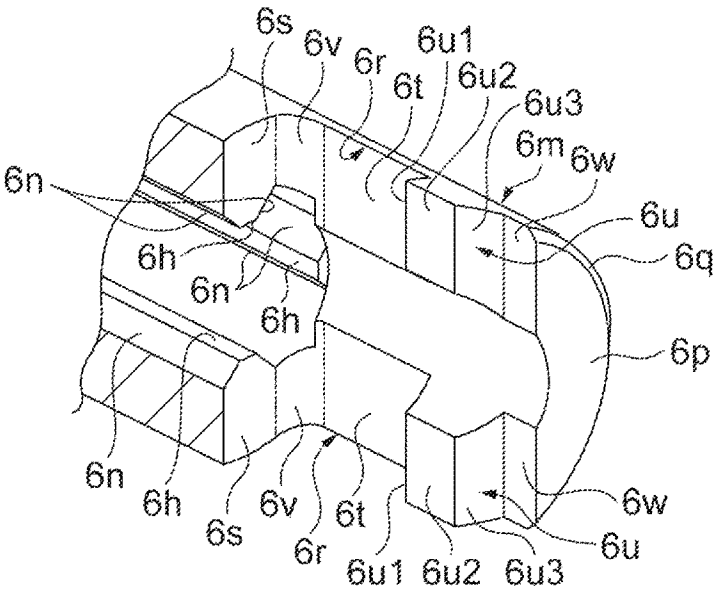
FIG. 12B is a perspective, partial cross-sectional view of the holder illustrated in FIG. 12A, showing the portion around the rear end of the holder in an enlarged manner.

FIG. 12A is a perspective, partial cross-sectional view of the holder 6, and FIG. 12B is a perspective, partial cross-sectional view of the holder 6, illustrating the portion around the rear end of the holder 6 in an enlarged manner. The pair of slits 6*r* are provided symmetrically about the axis of the tubular portion 6*m*. Further, the ridges 6*h* provided in the tubular portion 6*c* extend to the front end of the tubular portion 6*m*, that is, to a boundary between the tubular portion 6*c* and the tubular portion 6*m*. In some examples, the ridges 6*h* are not provided in the tubular portion 6*m*.

Figure 13A:
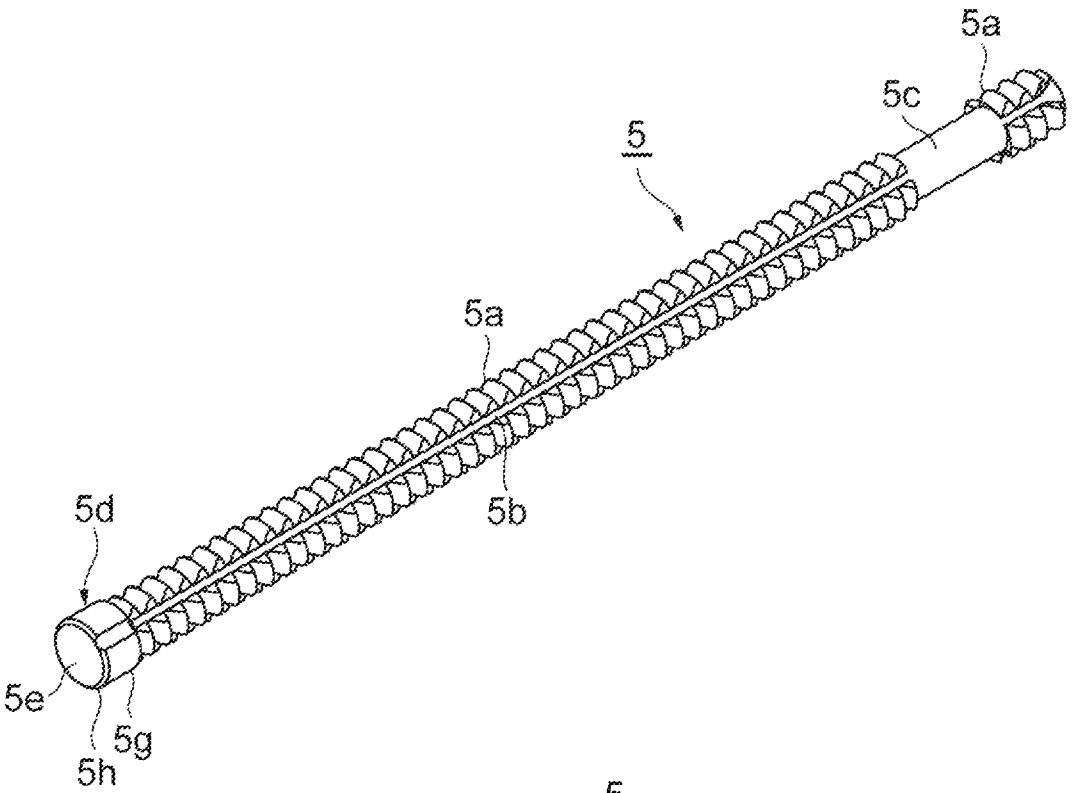
FIG. 13A is a perspective view of a mobile body.
Figure 13B:
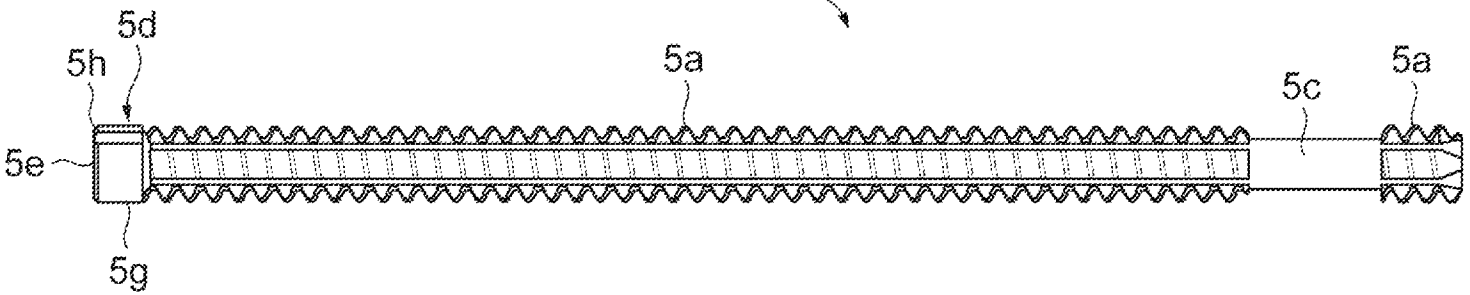
FIG. 13B is a side view of the mobile body.

FIG. 13A is a perspective view of the mobile body 5, and FIG. 13B is a side view of the mobile body 5. The mobile body 5 has a rod-like outer shape. An example material of the mobile body 5 includes POM. The mobile body 5 includes the male thread 5*a* and four groove portions 5*b* extending in the axial direction on the outer peripheral surface of mobile body 5. The groove portions 5*b* are provided at four positions equally distanced from each other in the circumferential direction.

The mobile body 5 includes, on a rear side surface thereof, a curved surface portion 5*c* on which no male thread 5*a* is formed. The curved surface portion 5*c* may be configured to cause the mobile body 5 to be idle rotation when the mobile body 5 reaches a forward limit. Further, the male thread 5*a* located behind the curved surface portion 5*c* may be configured to prevent the mobile body 5 from falling off from the holder 6 with the mobile body 5 inserted into the rear side of the projection 6*f* when assembled to the holder 6 (see FIG. 3). The male thread 5*a* is formed throughout the mobile body 5 in the axial direction. For example, the male thread 5*a* may be formed wholly in the axial direction. In other examples, there may be a portion where no male thread 5*a* is formed, such as where the curved surface portion 5*c* is formed in the middle in the axial direction.

The four groove portions 5*b* of the mobile body 5 may be configured to be fitted into the ridges 6*h* of the holder 6 (see FIG. 8). Additionally, the groove portions 5*b* may be configured to cause the mobile body 5 and the holder 6 to rotate synchronously. The groove portions 5*b* cause a cross-section of the male thread 5*a* and the groove portions 5*b* taken along a plane orthogonal to the axial direction to have a noncircular shape (e.g. cross shape) corresponding to the internal space of the tubular portion 6*c* of the holder 6.

A pitch of the male thread 5*a* of the mobile body 5 (i.e. a distance between crests of the male thread 5*a* in the axial direction) is, for example, between 0.3 mm and 1.0 mm or less. In some examples, the pitch may be approximately 0.6 mm.

The male thread 5*a* and the groove portions 5*b* of the mobile body 5 are inserted into the holder 6 from the front so that the groove portions 5*b* has a clearance with respect to the ridges 6*h*. Then, the projection 6*f* provided on the inner surface 6*e* of the holder 6 is engaged with the male thread 5*a* of the mobile body 5 to cause the holder 6 to hold the mobile body 5. The projection 6*f* presses the male thread 5*a* from the outer side in the radial direction, thereby increasing a holding force of the holder 6 with respect to the mobile body 5.

Located at the front end of the mobile body 5 is a push-out portion 5*d* that has a columnar shape and is configured to push out the drawing material M in the pipe member 1 in a forward direction. The push-out portion 5*d* includes a bottom surface 5*e* located at the front end thereof, a side surface 5*g* extending in the circumferential direction, and a tapered surface 5*h* inclined relative to the bottom surface 5*e* and contiguously extending to the bottom surface 5*e* and the side surface 5*g*. The bottom surface 5*e* may be configured to push out the drawing material M in the forward direction.

Figure 14A:
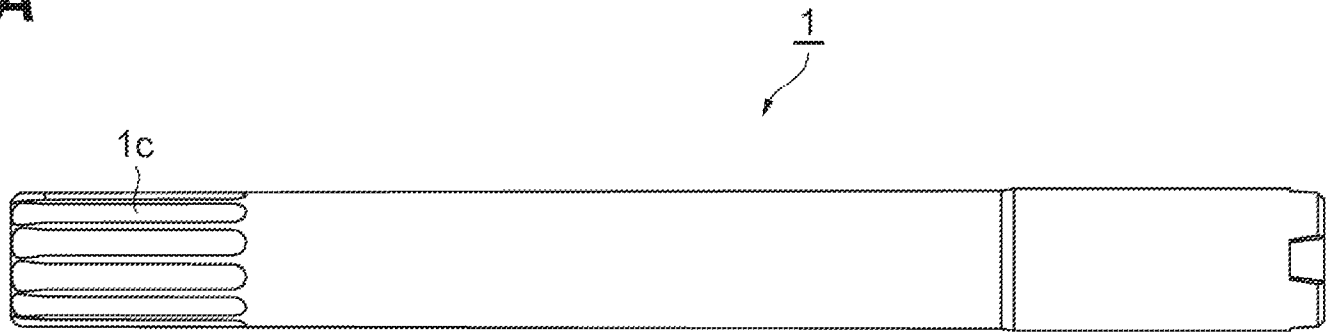
FIG. 14A is a side view of a pipe member.
Figure 14B:
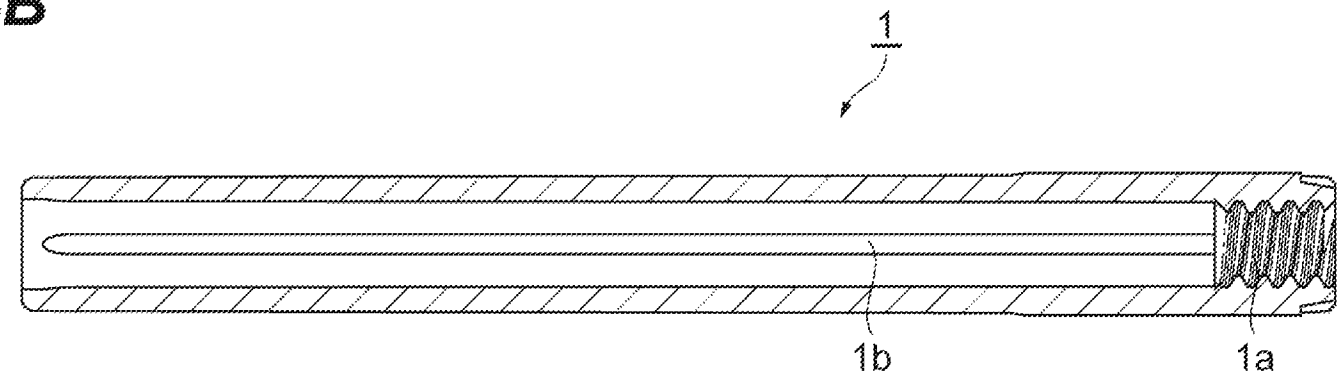
FIG. 14B is a longitudinal cross-sectional view of the pipe member.

FIG. 14A is a side view of the pipe member 1, and FIG. 14B is a longitudinal cross-sectional view of the pipe member 1. The pipe member 1 has a substantially tubular shape. An example material of the pipe member 1 includes polypropylene (PP). The pipe member 1 may be colored the same color as the drawing material M or may be made of a transparent material to facilitate the identification of the color of the drawing material M. Located on a rear side of an inner peripheral surface of the pipe member 1 is a female thread 1*a* configured to move the mobile body 5 in the axial direction. In some examples, the pitch of the female thread 1*a* of the pipe member 1 (a distance between crests of the female thread 1*a* in the axial direction) may be approximately the same as the male thread 5*a* of the mobile body 5.

Located in front of the female thread 1*a* on the inner surface of the pipe member 1 are ridges 1*b* extending in the axial direction and arranged at four positions equally distanced from each other in the circumferential direction. The ridges 1*b* may be configured to prevent the drawing material M loaded in the pipe member 1 from coming off. While various examples may include a different number of ridges 1*b*, in an example including four ridges 1*b* the drawing material M can be readily prevented from coming off. Located on a front side of an outer peripheral surface of the pipe member 1 are recessed grooves 1*c* configured to be engaged with the ridges 2*e* of the front barrel 2 in the rotational direction. In some examples, the recessed grooves 1*c* include a plurality of recessed portions arranged in the circumferential direction and extending by a predetermined length in the axial direction.

Figure 15:
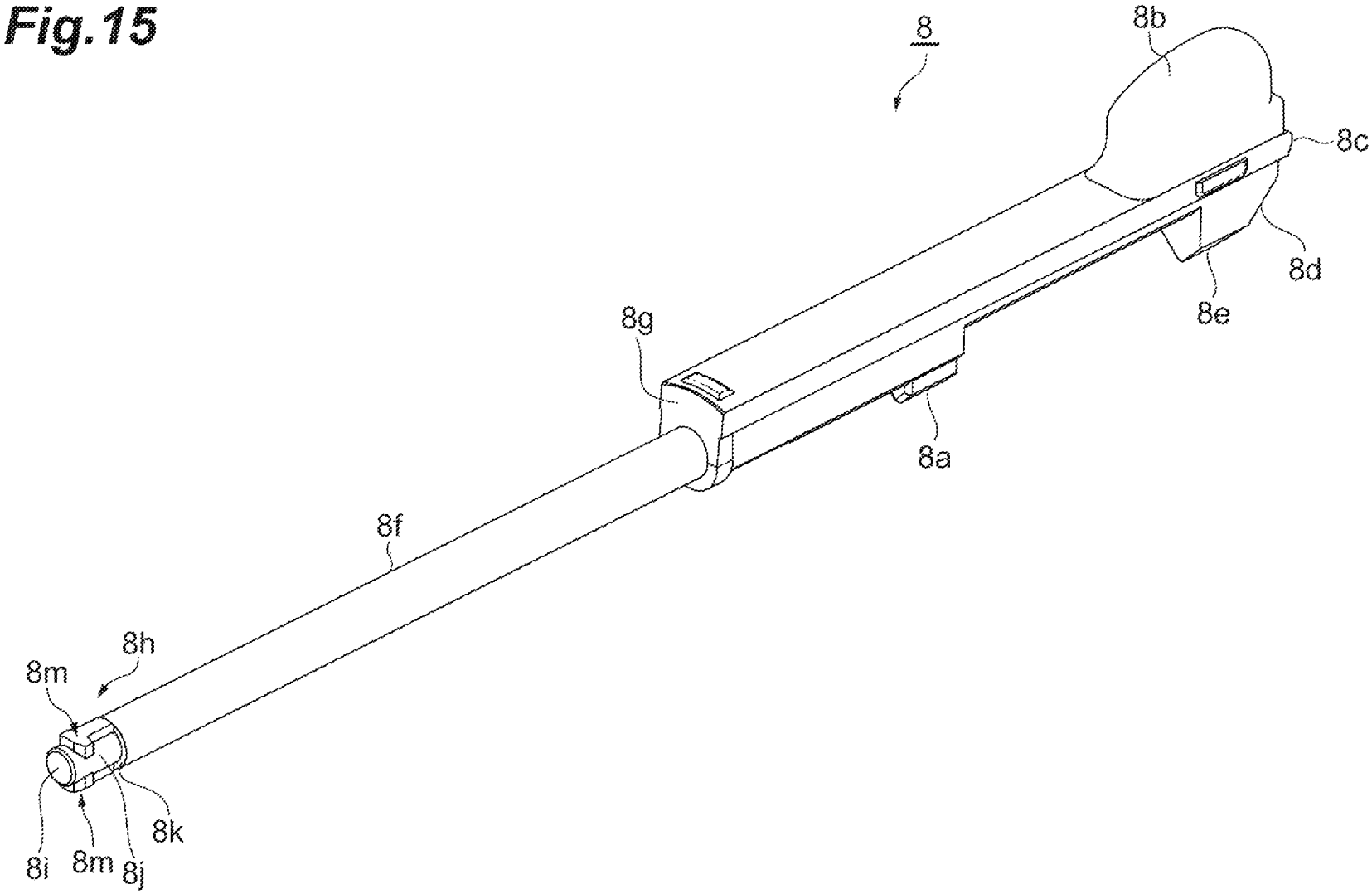
FIG. 15 is a perspective view of a slider.
Figure 16A:
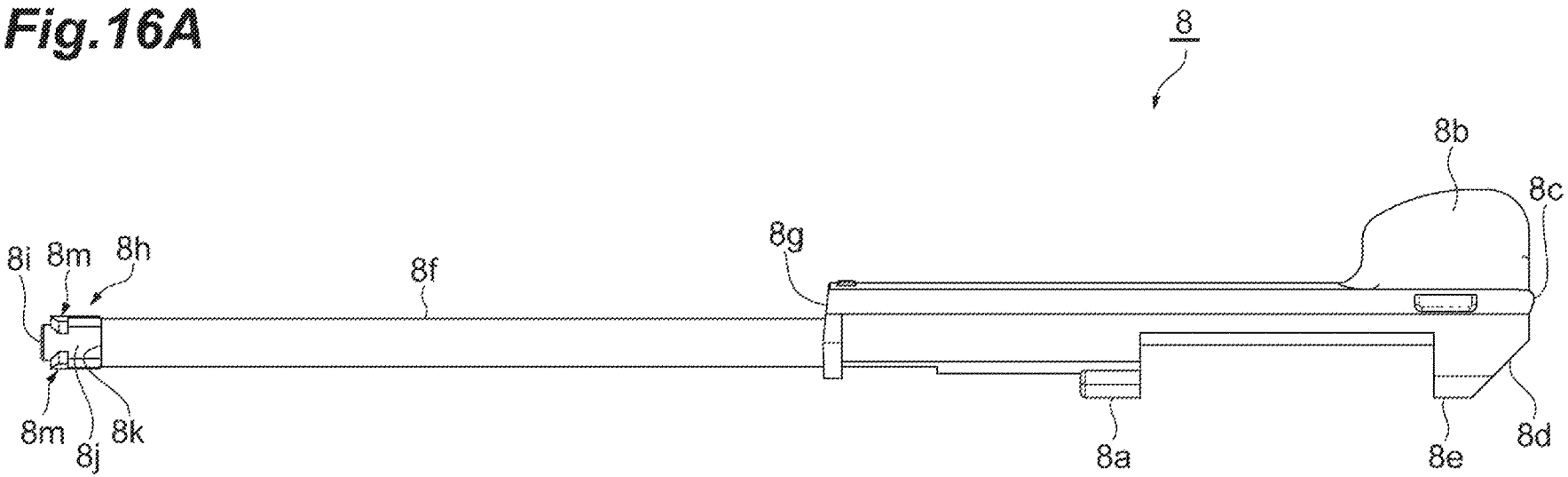
FIG. 16A is a side view of the slider illustrated in FIG. 15.
Figure 16B:
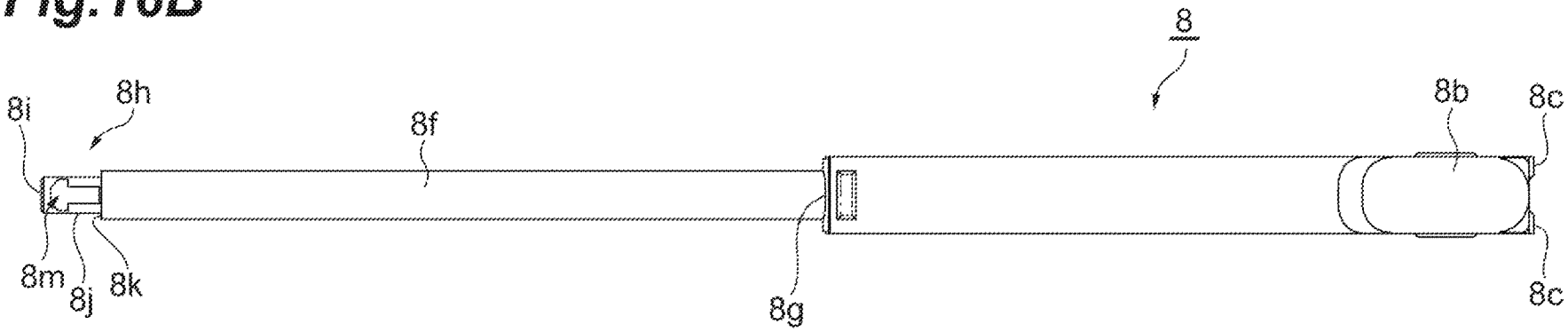
FIG. 16B is a side view of the slider illustrated in FIG. 15 as viewed from a direction different from the direction of FIG. 16A.

FIG. 15 is a perspective view of the slider 8. FIG. 16A is a side view of the slider 8, and FIG. 16B is a side view of the slider 8 as viewed from a direction different from the direction of FIG. 16A. An example material of the slider 8 includes POM resin. A color of the slider 8 is, for example, the same as the color of a corresponding drawing material M. Sliding the slider 8 having a particular color forward by a fixed amount exposes the drawing material M having the particular color from the opening 2*a* of the front barrel 2 (see FIG. 5).

The slider 8 has a shape extending in the axial direction. Located on a rear side of the slider 8 is a projection portion 8*a* configured to cause another slider 8 to be pulled back. The projection portion 8*a* projects inward in the radial direction in the main body barrel 3 and extends in the axial direction (see FIG. 3). Located at a rear end of the slider 8 are a projection portion 8*b* projecting outward in the radial direction from the main body barrel 3, and a rear end portion 8*c* projecting rearward at the rear end of the slider 8 and configured to be caught in the main body barrel 3. Additionally, a projection portion 8*e* projecting inward in the radial direction of the main body barrel 3, and having an inclined surface 8*d* with which the projection portion 8*a* of another slider 8 comes into contact, may be located at the rear end of the slider 8.

Located on a front side of the slider 8 is a rod portion 8*f* having a round rod shape and around which the spring 9 is wound (see FIG. 4 and FIG. 5). Additionally, located at a rear end of the rod portion 8*f* is a surface 8*g* having a flat shape and projecting outward in the radial direction from the rod portion 8*f*. The rod portion 8*f* is inserted into the opening 11*t* (see FIG. 7B) of the holder accommodating portion 11*s* of the middle barrel 11 in the axial direction. Further, one end of the spring 9 is in contact with the surface 8*g*. In some examples, the slider 8 includes the rod portion 8*f* provided on the front side thereof and the surface 8*g* projecting outward in the radial direction at the rear end of the rod portion 8*f* to allow the spring 9 to be readily mounted.

Figure 17A:
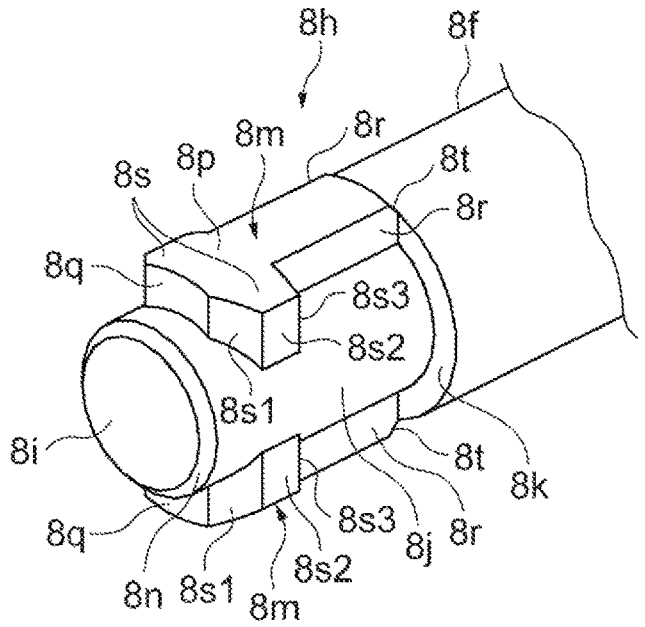
FIG. 17A is an enlarged perspective view of a portion around a front end of the slider illustrated in FIG. 15.
Figure 17B:
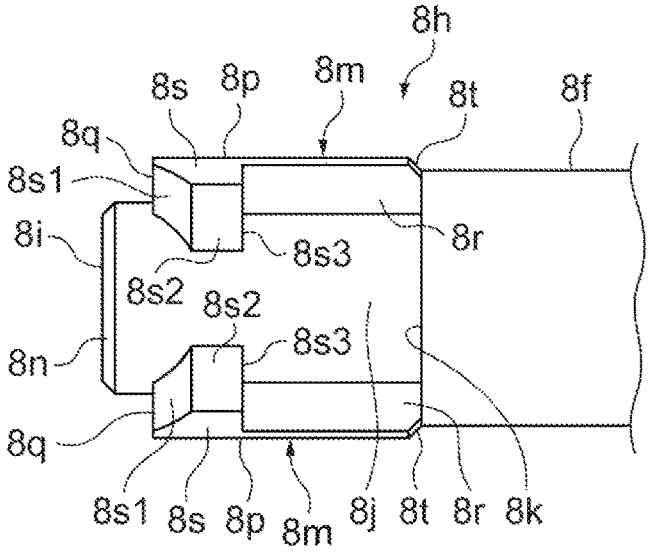
FIG. 17B is a side view of the portion around the front end of the slider illustrated in FIG. 17A.
Figure 17C:
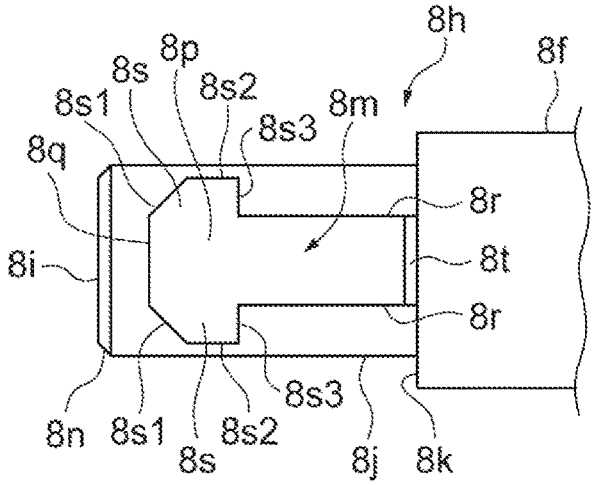
FIG. 17C is a side view of the portion around the front end of the slider illustrated in FIG. 17A as viewed from a direction different from the direction of FIG. 17B.

FIG. 17A is an enlarged perspective view of a front end of the slider 8, FIG. 17B is a side view of the front end of the slider 8, and FIG. 17C is a side view of the front end of the slider 8 as viewed from a direction different from the direction of FIG. 17B. Located at the front end of the slider 8 is an insertion portion 8*h* (second engagement portion) configured to be inserted into the tubular portion 6*m* of the holder 6 from the rear and to be engaged with the tubular portion 6*m* in the axial direction. The insertion portion 8*h* projects forward from the front end of the rod portion 8*f* and has a generally cylindrical shape.

The insertion portion 8*h* includes a front end surface 8*i* located at the front end thereof, and an outer peripheral surface 8*j* having a cylindrical surface shape and extending rearward from the front end surface 8*i*. Additionally, the insertion portion 8*h* may include a surface 8*k* projecting outward in the radial direction from the rear end of the outer peripheral surface 8*j*, and the projection 8*m* projecting outward in the radial direction from the outer peripheral surface 8*j*. The front end surface 8*i* is a flat surface along the radial direction and the circumferential direction. Located on a periphery of the front end surface 8*i* is an inclined surface 8*n* inclined outward in the radial direction while extending rearward from the front end surface 8*i*. The insertion portion 8*h* may be configured to be readily inserted into the tubular portion 6*m* from the rear due to the inclined surface 8*n*.

The outer peripheral surface 8*j* is smaller in outer diameter than the rod portion 8*f*. Further, the outer diameter of the outer peripheral surface 8*j* may be the same as or slightly smaller than the inner diameter of the tubular portion 6*m*. The surface 8*k* is a flat surface that is oriented along the radial direction and the circumferential direction and that extends in the radial direction between the outer peripheral surface 8*j* and an outer peripheral surface of the rod portion 8*f*. Projections 8*m* are located on opposite sides from each other in the radial direction on the outer peripheral surface 8*j*, the positions of the projections 8*m* corresponding to the positions where the slits 6*r* are located. The projection 8*m* and the slit 6*r* are both provided at each of the opposite sides from each other in the radial direction (i.e., at two positions located equidistant from each other in the circumferential direction).

The projection 8*m* is inserted into the slit 6*r* from the rear and is engaged with the slit 6*r* in the axial direction. The projection 8*m* has a T-shape extending in the axial direction and having an expanded front side, as viewed from the radial direction. A front end of the projection 8*m* is located behind the front end surface 8*i*, and a rear end of the projection 8*m* is connected to the surface 8*k*. The projection 8*m* includes a top surface 8*p* located outward in the radial direction of the outer peripheral surface 8*j*, and a front end surface 8*q* located at the front end of the projection 8*m*. Additionally, the projection 8*m* may include a pair of side surfaces 8*r* extending rearward of the front end surface 8*q*, and a pair of raised portions 8*s* provided between the front end surface 8*q* and the pair of side surfaces 8*r*.

The top surface 8*p* is formed in a curved shape along the axial direction and the circumferential direction, and is located outward in the radial direction of the outer peripheral surface of the rod portion 8*f*. In some examples, the curvatures of the pair of top surfaces 8*p* located on opposite sides of the insertion portion 8*h* from each other in the radial direction may be identical to each other. A distance between the pair of top surfaces 8*p* (i.e. a maximum dimension in the radial direction of the insertion portion 8*h*) is smaller than the outer diameter d1 of the tubular portion 6*m* (see FIG. 11B). Located at the rear end of the top surface 8*p* is an inclined surface 8*t* inclined inward in the radial direction while extending rearward. The inclined surface 8*t* continuously extends to the outer peripheral surface of the rod portion 8*f*.

The front end surface 8*q* is provided between the top surface 8*p* and the outer peripheral surface 8*j*. The front end surface 8*q* is a flat surface along the front end surface 8*i* and is formed substantially perpendicular to the outer peripheral surface 8*j*. The pair of side surfaces 8*r* of each of the projections 8*m* are located on opposite sides of the insertion portion 8*h* from each other in the circumferential direction. Each of the side surfaces 8*r* is formed extending from the surface 8*k* toward the front end surface 8*q* and substantially perpendicular to the surface 8*k* and the front end surface 8*q*.

Each of the pair of raised portions 8*s* of each of the projections 8*m* projects from the front end of a corresponding one of the side surfaces 8*r* in the circumferential direction and has a rectangular shape as viewed from the radial direction. The raised portions 8*s* are provided symmetrically about a reference plane passing through the axis and a center of a width of the projection 8*m*. Each of the raised portions 8*s* includes a tapered surface 8*s*1 provided on the front side thereof, a top surface 8*s*2 extending rearward from the tapered surface 8*s*1, and a rear end surface 8*s*3 extending contiguously to the top surface 8*s*2 and the side surface 8*r* and serving as a rear end of the raised portion 8*s*.

The tapered surface 8*s*1 is inclined so as to be tapered toward the front end surface 8*q*. In some examples, the pair of tapered surfaces 8*s*1 located on opposite sides of the raised portion 8*s* from each other are inclined so as to be closer to each other toward the front end surface 8*q*. The tapered surface 8*s*1 extends along the tapered surface 6*u*3 of the raised portion 6*u* of the slit 6*r*, and in some examples, extends parallel to the tapered surface 6*u*3. The projection 8*m* is shaped so as to be readily inserted into the slit 6*r* from the rear due to the tapered surface 8*s*1.

The top surface 8*s*2 is located on a side apart from the center of the width of the projection 8*m* as compared with the side surface 8*r*. The top surface 8*s*2 extends along the side surface 8*r*, and in some examples, extends parallel to the side surface 8*r*. The rear end surface 8*s*3 is a flat surface along the front end surface 8*q*, and in some examples, extends parallel to the front end surface 8*q*. The rear end surface 8*s*3 is formed substantially perpendicular to the top surface 8*s*2 and the side surface 8*r*.

Figure 18A:
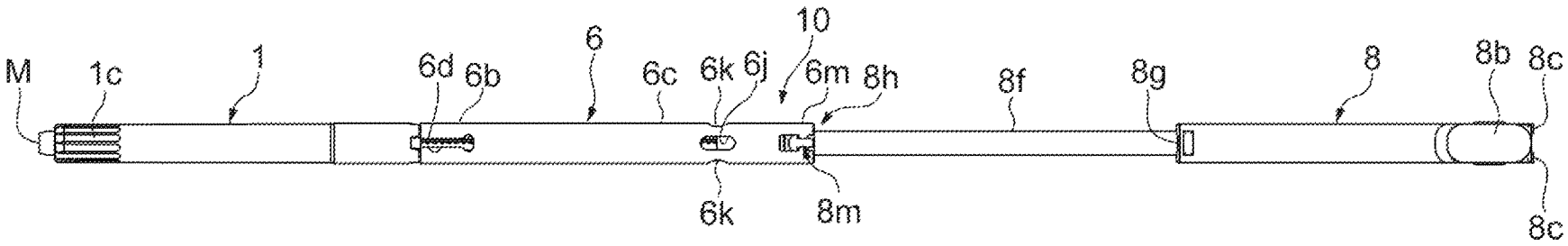
FIG. 18A is a side view of the slider and the cartridge.
Figure 18B:
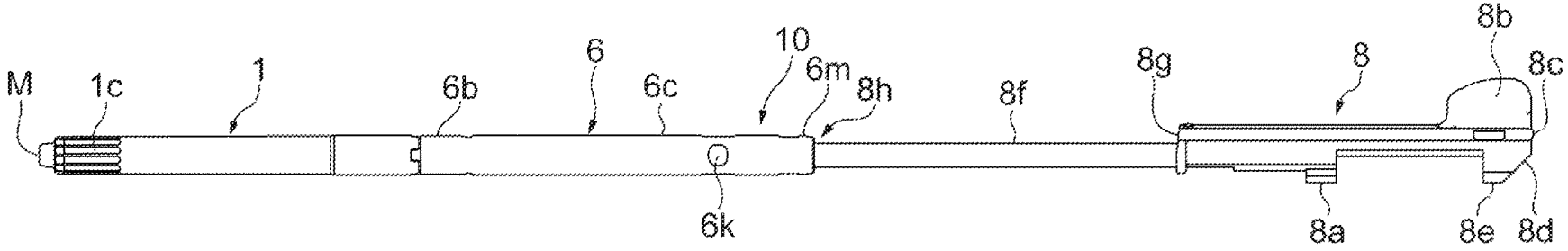
FIG. 18B is a side view of the slider and the cartridge illustrated in FIG. 18A as viewed from a direction different from the direction of FIG. 18A.
Figure 19A:
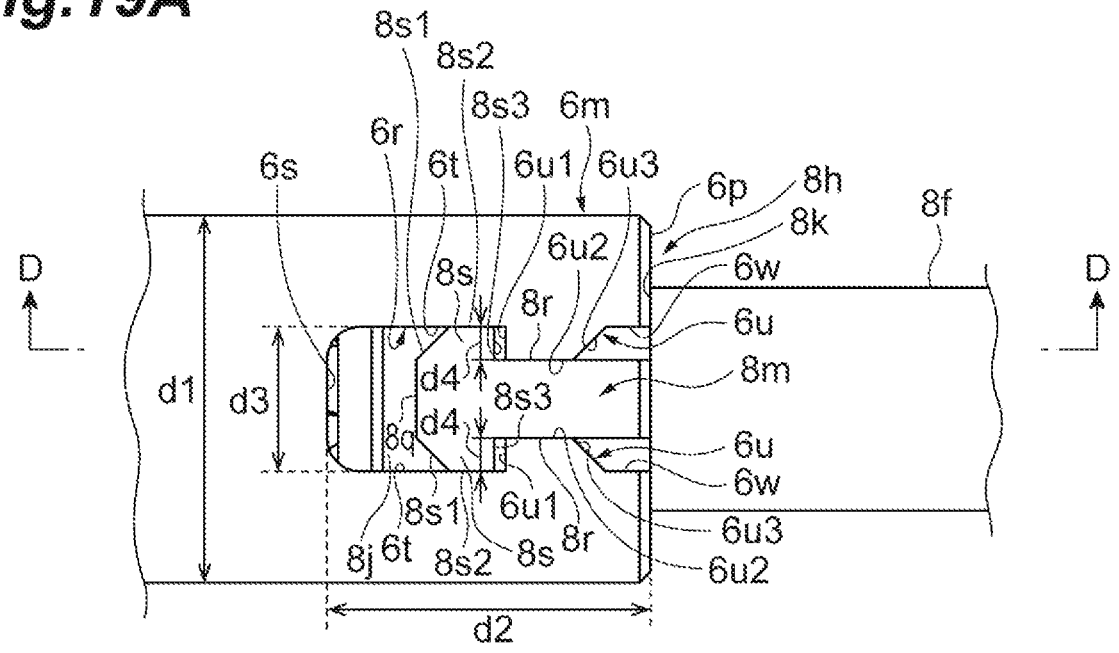
FIG. 19A is an enlarged side view of main portions of the slider and the cartridge illustrated in FIG. 18A.
Figure 19B:
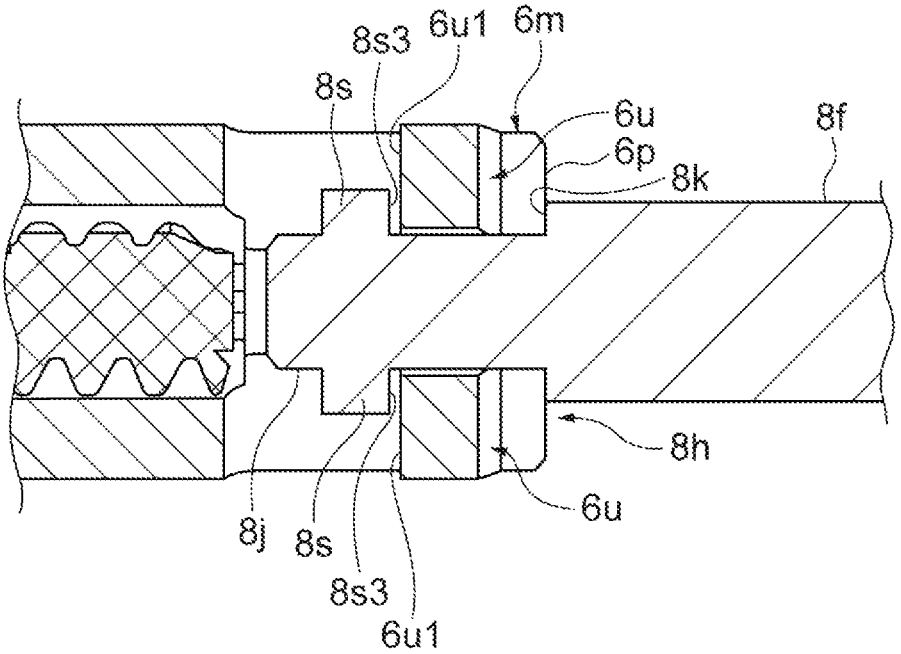
FIG. 19B is a cross-sectional view taken along line D-D of FIG. 19A.

The insertion portion 8*h* of the slider 8 may be inserted into the tubular portion 6*m* of the holder 6 in the axial direction and then engaged with the tubular portion 6*m* in the axial direction. FIG. 18A is a side view of the slider 8 and the cartridge 10, and FIG. 18B is a side view of the slider 8 and the cartridge 10 as viewed from a direction different from the direction of FIG. 18A. FIG. 19A is an enlarged side view of main portions of the slider 8 and the cartridge 10, and FIG. 19B is a cross-sectional view taken along line D-D of FIG. 19A.

When the insertion portion 8*h* is inserted into the tubular portion 6*m*, the projection 8*m* of the insertion portion 8*h* is inserted into the slit 6*r* of the tubular portion 6*m* from the rear. Each of the raised portions 8*s* of the projection 8*m* enters a space in front of a corresponding one of the raised portions 6*u* of the slit 6*r*, is caught in the raised portion 6*u*, and then is engaged with the raised portion 6*u* in the axial direction. In some examples, the rear end surface 8*s*3 of each of the raised portions 8*s* and the front end surface 6*u*1 of a corresponding one of the raised portions 6*u* oppose each other in the axial direction. Accordingly, when the cartridge 10 including the holder 6 is pulled forward, the front end surface 6*u*1 of each of the raised portions 6*u* comes into contact with the rear end surface 8*s*3 of a corresponding one of the raised portions 8*s*. The contact between the front end surface 6*u*1 and the rear end surface 8*s*3 restricts forward movement of the cartridge 10 relative to the slider 8.

As shown in FIG. 19A, the outer peripheral surface 8*j* of the insertion portion 8*h* may be configured to oppose the inner peripheral surface of the tubular portion 6*m*, and the surface 8*k* of the insertion portion 8*h* may be configured to oppose the rear end surface 6*p* of the tubular portion 6*m* during one or more modes of operation. When the surface 8*k* opposes the rear end surface 6*p*, the cartridge 10 is pushed rearward, the rear end surface 6*p* comes into contact with the surface 8*k*. The contact between the rear end surface 6*p* and the surface 8*k* restricts rearward movement of the cartridge 10 relative to the slider 8.

In some examples, the pair of inner wall surfaces 6*t* of the slit 6*r* may be configured to be in contact with the top surfaces 8*s*2 of the pair of raised portions 8*s*. The distance d3 between the pair of inner wall surfaces 6*t* is the same as a distance between the pair of top surfaces 8*s*2. The top surfaces 6*u*2 of the pair of raised portions 6*u* are in contact with the pair of side surfaces 8*r* of the projection 8*m*. The distance d4 between the top surface 6*u*2 and the inner wall surface 6*t* is the same as the distance between the top surface 8*s*2 and the side surface 8*r* (i.e. a height of the raised portion 8*s* from the side surface 8*r*).

The inner wall surface 6*t* and the top surface 6*u*2 come into contact with the top surface 8*s*2 and the side surface 8*r*, respectively, thereby causing the cartridge 10 to engage with the slider 8 in the rotational direction. In some examples, the front end surface 8*q* of the projection 8*m* is located apart from the inner wall surface 6*s* of the slit 6*r* by a predetermined distance to absorb an assembly tolerance and the like when the projection 8*m* is engaged with the slit 6*r* in the axial direction.

Figure 20A:
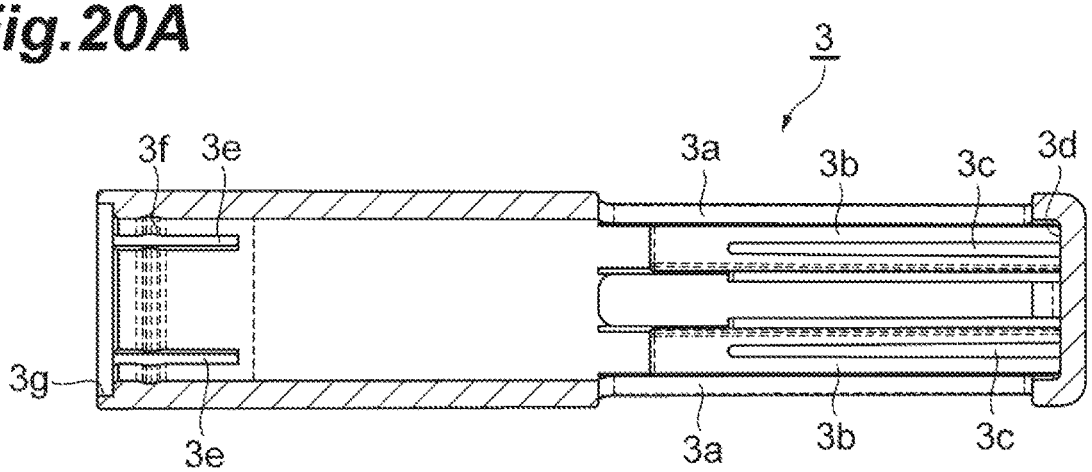
FIG. 20A is a longitudinal cross-sectional view of a main body barrel.
Figure 20B:
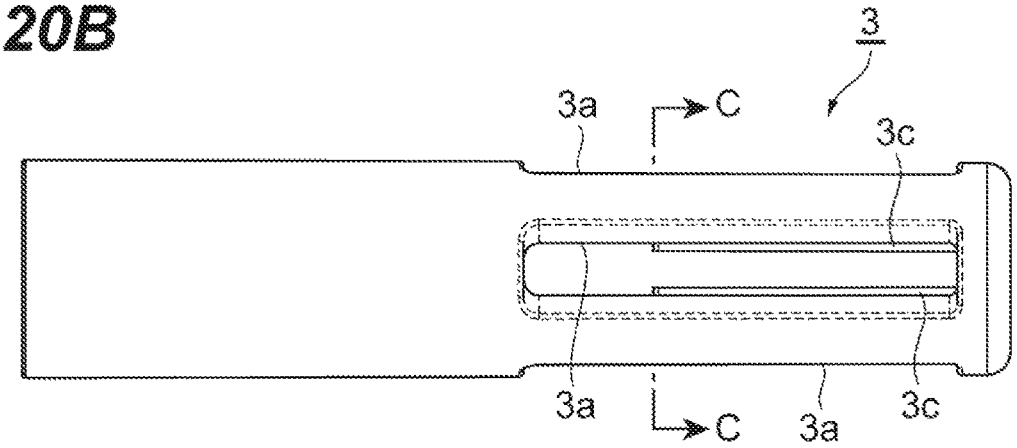
FIG. 20B is a side view of the main body barrel.
Figure 20C:
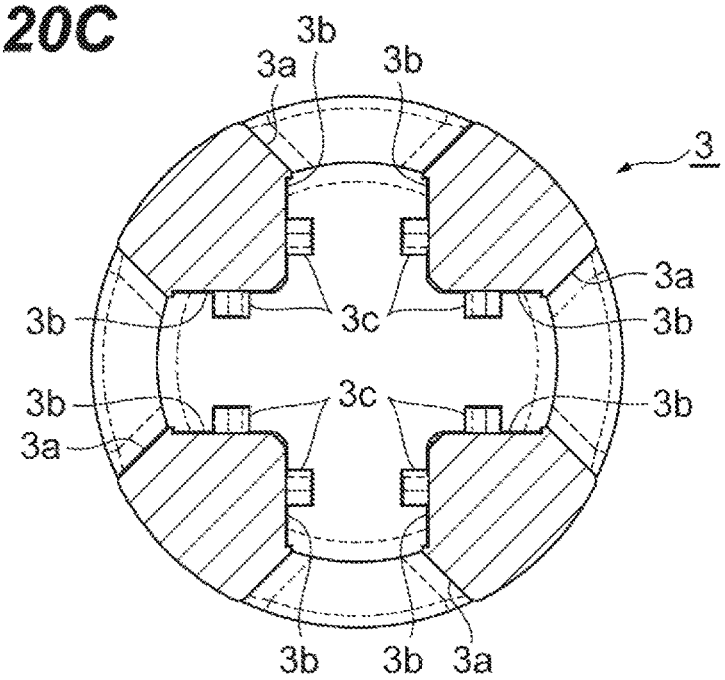
FIG. 20C is a cross-sectional view taken along line C-C of FIG. 20B.

FIG. 20A is a longitudinal cross-sectional view of the main body barrel 3, FIG. 20B is a side view of the main body barrel 3, and FIG. 20C is a cross-sectional view taken along line C-C of FIG. 20B. The main body barrel 3 is an injection-molded product made of ABS resin, and has a bottomed tubular shape. Located on a rear side of the main body barrel 3 is a cutout portion 3*a* extending in the axial direction and allowing the projection portion 8*b* of the slider 8 to project outward. The cutout portion 3*a* may be provided at four positions equally distanced from each other in the circumferential direction.

Located on an inner side in the radial direction of the cutout portion 3*a* in the main body barrel 3 are a flat portion 3*b* extending inward in the radial direction from the cutout portion 3*a*, and a projection portion 3*c* extending in the axial direction on the flat portion 3*b*. A rear side of the projection portion 3*c* extends to a bottom surface 3*d* of the main body barrel 3. When the projection portion 8*b* of the slider 8 is moved forward along the cutout portion 3*a* of the main body barrel 3, the rear end portion 8*c* of the slider 8 is moved forward along the projection portion 3*c* (see FIG. 5).

When the rear end portion 8*c* reaches the front end of the projection portion 3*c*, the rear end portion 8*c* enters inward of the cutout portion 3*a* in the radial direction and is then caught in the front end of the projection portion 3*c*. When the rear end portion 8*c* of one slider 8 is caught in the front end of the projection portion 3*c*, the projection portion 8*a* of another slider 8 is close to the inclined surface 8*d* of the one slider 8.

With reference to FIG. 20A, located on the front side of the inner peripheral surface of the main body barrel 3 are a recessed groove 3*e* configured to be engaged with the ridge 11*q* of the middle barrel 11 in the rotational direction, and an annular recessed portion 3*f* configured to be engaged with the raised portion 11*r* of the middle barrel 11 in the axial direction. Additionally, an annular recessed portion 3*g* where the flange portion 11*p* of the middle barrel 11 enters from the front may be located on the front side of the inner peripheral surface of the main body barrel 3. The recessed groove 3*e* extends rearward from the annular recessed portion 3*g* located at the front end of the main body barrel 3 by a predetermined length. Each of the recessed grooves 3*e* is disposed on the inner peripheral surface of the main body barrel 3 at four positions equally distanced from each other in the circumferential direction. Further, the annular recessed portion 3*f* extends in the circumferential direction between the recessed grooves 3*e*.

The four sliders 8 are inserted into the main body barrel 3 from the front side of the main body barrel 3, and the projection portions 8*b* of the sliders 8 project outward from the cutout portions 3*a*. The middle barrel 11 enters the front end of the main body barrel 3. When the middle barrel 11 enters the main body barrel 3, the ridge 11*q* of the middle barrel 11 enters the recessed groove 3*e* of the main body barrel 3, and the raised portion 11*r* of the middle barrel 11 is engaged with the annular recessed portion 3*f* of the main body barrel 3 in the axial direction. Additionally, the flange portion 11*p* of the middle barrel 11 enters the annular recessed portion 3*g*, thereby causing the middle barrel 11 to engage with the main body barrel 3 in such a way as to be synchronously rotatable.

As illustrated in FIG. 4 and FIG. 5, the spring 9 (e.g. springs 9A to 9C) is wound around the rod portion 8*f* of the slider 8 with a clearance provided with respect to the outer periphery of the rod portion 8*f*. The front end of the spring 9 is in contact with the rear wall of the holder accommodating portion 11*s* in the middle barrel 11, and the rear end of the spring 9 is in contact with the surface 8*g* located near the center of the slider 8 in the axial direction. This causes the spring 9 to energize the slider 8 rearward.

An example operation using the feeding pencil 100 is described below. In the feeding pencil 100 in an initial state illustrated in FIG. 4, the four sliders 8 are each located at the rear end of a corresponding one of the cutout portions 3*a* of the main body barrel 3, and the four pipe members 1 are located inside the front barrel 2. In this state, when the slider 8A is moved forward along the cutout portion 3*a* by a fixed amount, as illustrated in FIG. 5, the cartridge 10A engaged with the slider 8A in the axial direction is moved forward, and the drawing material M1 is exposed to the front from the opening 2*a* of the front barrel 2.

When the front side portion of the pipe member 1A enters the inner peripheral surface 2*d* of the front barrel 2, the rod portion 8*f* of the slider 8A is deformed in such a way as to curve in the axial direction, and the recessed groove 1*c* of the pipe member 1A is engaged with the ridges 2*e* of the front barrel 2 in the rotational direction. Then, the rear end portion 8*c* of the slider 8A enters inward in the radial direction at the front end of the projection portion 3*c* of the main body barrel 3.

In some examples, when the user rotates the main body barrel 3 relative to the front barrel 2 in one direction (e.g. clockwise), the middle barrel 11, the four sliders 8, the four holders 6, and the four mobile bodies 5 start to rotate in the one direction. The pipe members 1B to 1D whose recessed grooves 1*c* are not engaged with the ridges 2*e* of the front barrel 2 rotate in response to the relative rotation in the one direction.

In some examples, the holder 6A connected using the mobile body 5A to the pipe member 1A whose recessed groove 1*c* is engaged with the ridges 2*e* of the front barrel 2 starts to rotate in a first direction in response to the relative rotation in the first direction. The pipe member 1A whose recessed groove 1*c* is engaged with the ridges 2*e* of the front barrel 2 may not rotate synchronously with the rotation of the mobile body 5A in the first direction, and the mobile body 5A rotates relative to the pipe member 1A. Accordingly, the relative rotation in the first direction causes the male thread 5*a* of the mobile body 5 and the female thread 1*a* of the pipe member 1 to engage with each other, thereby causing the mobile body 5A to start to move forward relative to the pipe member 1A. Then, the bottom surface 5*e* of the push-out portion 5*d* of the mobile body 5A pushes out the drawing material M1 loaded in the pipe member 1A forward, thereby causing both the mobile body 5A and the drawing material M1 to start to move forward relative to the pipe member 1A.

During the relative rotation in the first direction, as illustrated in FIG. 8, the elastic projection 11*e* of the middle barrel 11 constituting part of the ratchet mechanism 12 is engaged with the raised and recessed portion 2*f* of the front barrel 2 in the rotational direction, and the springy force given by the cutout 11*f* energizes the elastic projection 11*e* in the radial direction, thereby causing the elastic projection 11*e* and the raised and recessed portion 2*f* to repeatedly engage with and disengage from (i.e. mesh with and release mesh with) each other. When the relative rotation in the first direction is made in a state where the elastic projection 11*e* and the raised and recessed portion 2*f* are engaged with each other in the rotational direction, the inclined surface 11*e*1 of the elastic projection 11*e* comes into contact with the inclined surface 2*f*1 of the raised and recessed portion 2*f*, and in this state, the inclined surface 11*e*1 slides upward along the inclined surface 2*f*1.

After the elastic projection 11*e* climbs over a raised portion of the raised and recessed portion 2*f*, the elastic projection 11*e* and the raised and recessed portion 2*f* are engaged with each other in the rotational direction again. As a result, the user experiences a clicking or ratcheting sensation every time the elastic projection 11*e* and the raised and recessed portion 2*f* are engaged with and disengaged from each other. In some examples including 24 raised and recessed portions arranged in the circumferential direction in the raised and recessed portion 2*f*, the click feeling is given to the user every time a relative rotation is made in the first direction by 15°.

On the other hand, when the user tries to rotate the main body barrel 3 relative to the front barrel 2 in a second direction (e.g. counterclockwise) opposite to the first direction, the side surface 11*e*2 of the elastic projection 11*e* constituting part of the ratchet mechanism 12 comes into contact with the side surface 2*f*2 of the raised and recessed portion 2*f* to restrict a relative rotation in the second direction. This prevents the main body barrel 3 and the front barrel 2 from relatively rotating in the second (opposite) direction. That is, a rotational force (i.e. torque) in relative rotation in the first direction is set to a force that allows rotation to be readily made, and a rotational force in relative rotation in the second, opposite direction is set to a force that makes rotation difficult in relationship to the first direction. For example, when the outer diameter of the main body barrel 3 is designed to be about 14 mm, a torque associated with the relative rotation in the first direction may be set to 0.1 N·m (i.e. newton meter) or less, and a torque associated with the relative rotation in the second direction may be set to 0.2 N·m or more.

Figure 21A:
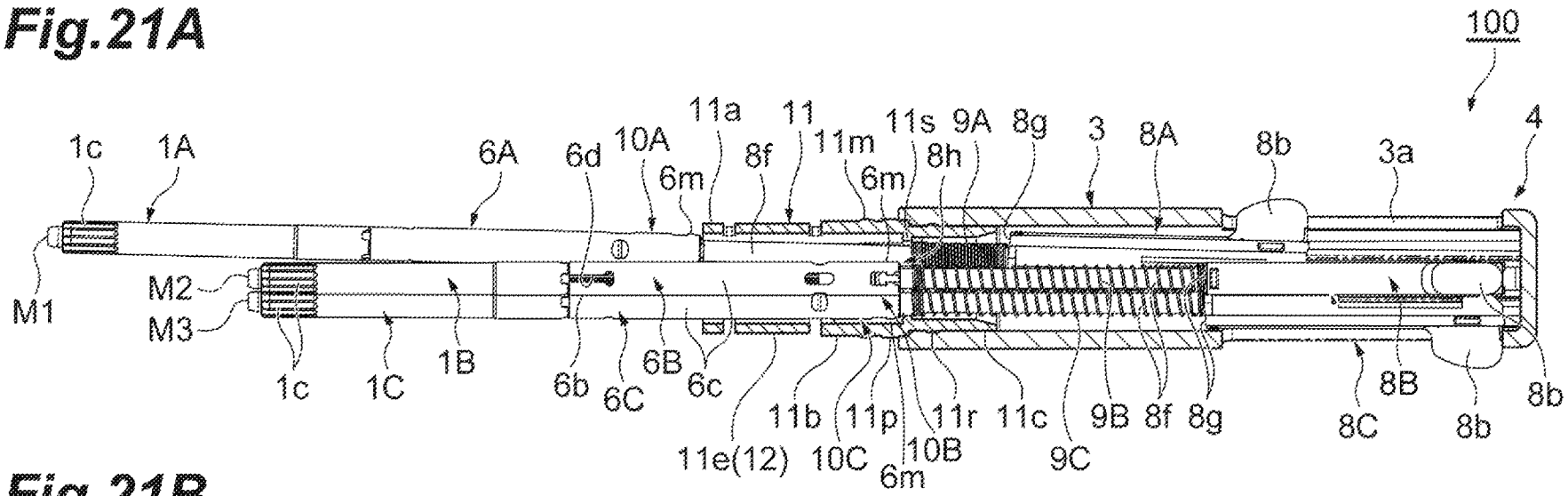
FIG. 21A is a partial longitudinal cross-sectional view of the feeding pencil, where the front barrel is detached from the main body barrel, and the slider is moved forward by a fixed amount relative to the main body barrel.
Figure 21B:
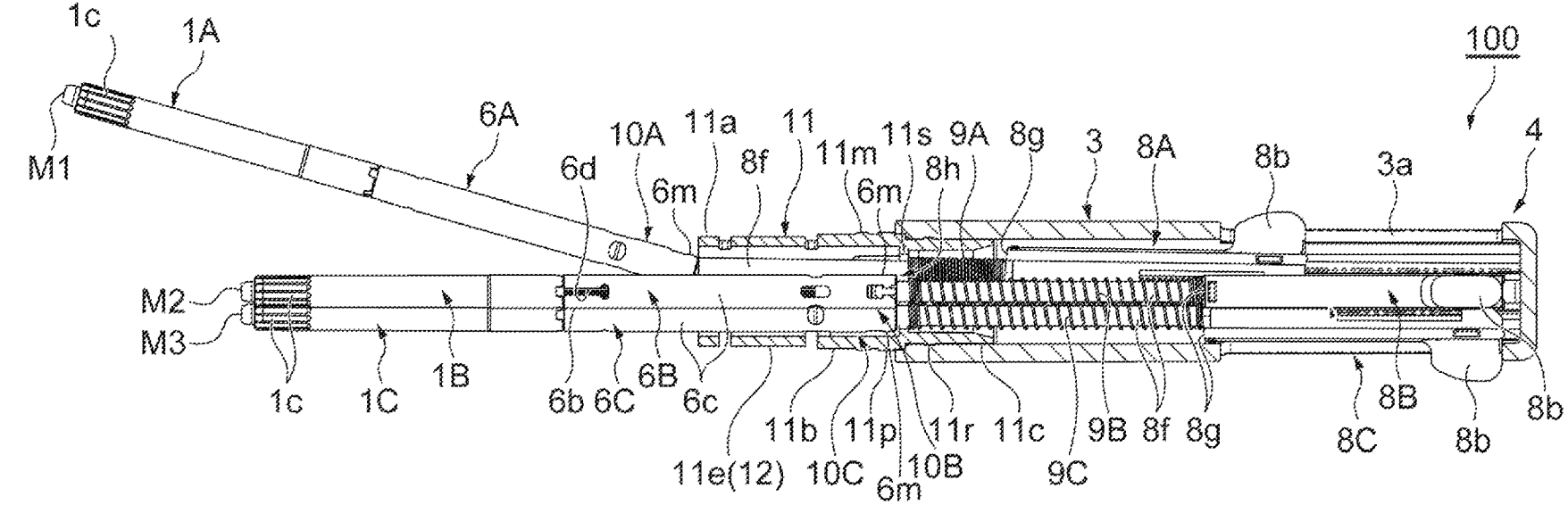
FIG. 21B is a partial longitudinal cross-sectional view of the feeding pencil, where the cartridge is tilted from the slider in the state illustrated in FIG. 21A.

An example operation of detaching the cartridge 10 from the slider 8 of the main body 4 is described below. FIG. 21A is a partial longitudinal cross-sectional view of the feeding pencil 100, illustrating a state where the front barrel 2 is detached from the main body barrel 3, and the slider 8A is moved forward by the fixed amount relative to the main body barrel 3. FIG. 21B is a partial longitudinal cross-sectional view of the feeding pencil 100, illustrating a state where the cartridge 10A is tilted from the slider 8A illustrated in FIG. 21A.

When the cartridge 10A is detached from the main body 4, the slider 8A is moved forward by a fixed amount relative to the main body barrel 3 with the front barrel 2 detached from the main body barrel 3 to expose the four cartridges 10. This brings the cartridge 10A into a state where the cartridge 10A is pushed forward relative to the other cartridges 10. Next, the cartridge 10A pushed forward is tilted toward one side in the radial direction relative to the slider 8A.

Figure 22A:
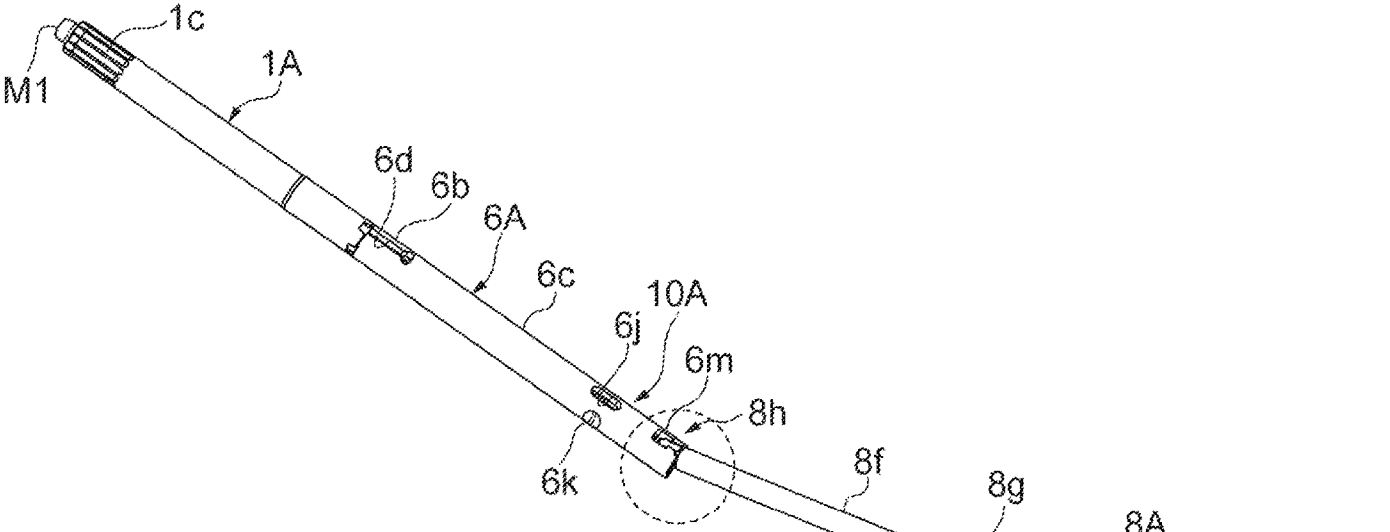
FIG. 22A is a perspective view of the cartridge and the slider of FIG. 21B.
Figure 22B:
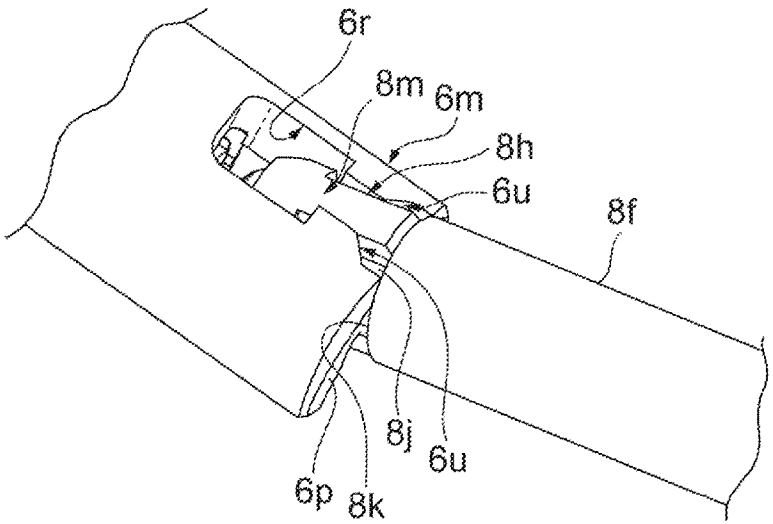
FIG. 22B is an enlarged perspective view of main portions of the cartridge and the slider of FIG. 22A.

FIG. 22A is a perspective view of the cartridge 10A and the slider 8A in the state illustrated in FIG. 21B, and FIG. 22B is an enlarged perspective view of main portions of the cartridge 10A and the slider 8A (a portion enclosed by the dashed line in FIG. 22A). When the cartridge 10A is tilted toward one side in the radial direction relative to the slider 8A (e.g. a side where the slit 6*r* and the projection 8*m* are located relative to the axis), the pair of raised portions 6*u* of the slit 6*r* come into contact with the outer peripheral surface 8*j* of the insertion portion 8*h*.

Figure 23A:
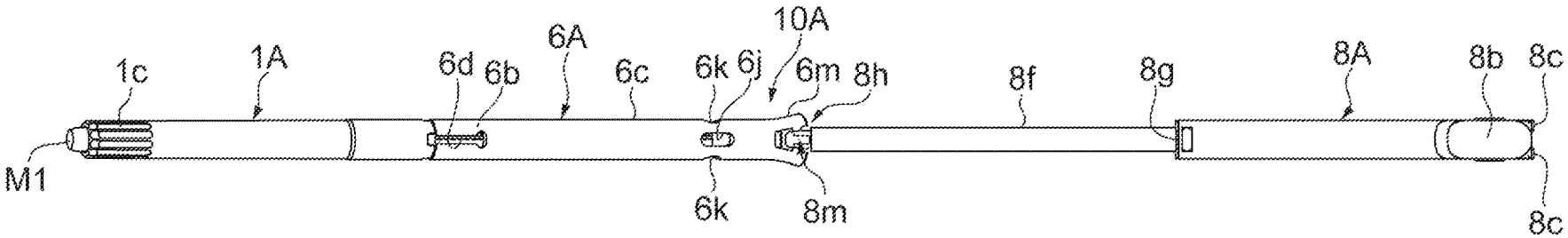
FIG. 23A is a side view of the cartridge and the slider, where the cartridge is further tilted from the slider of FIG. 22A.
Figure 23B:
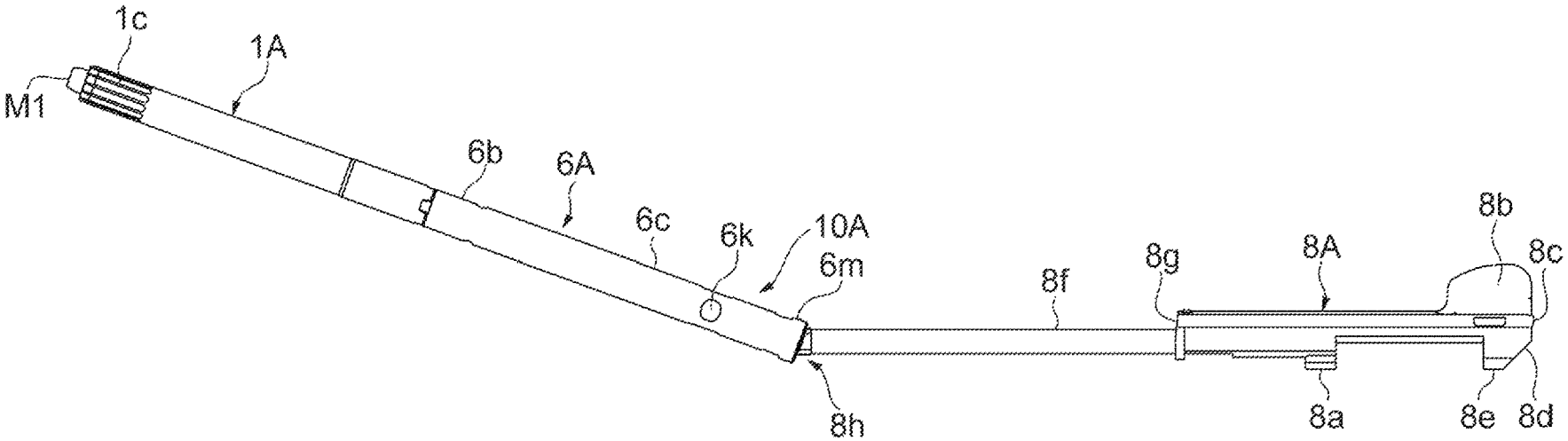
FIG. 23B is a side view of the cartridge and the slider illustrated in FIG. 23A as viewed from a direction different from the direction of FIG. 23A.
Figure 24:
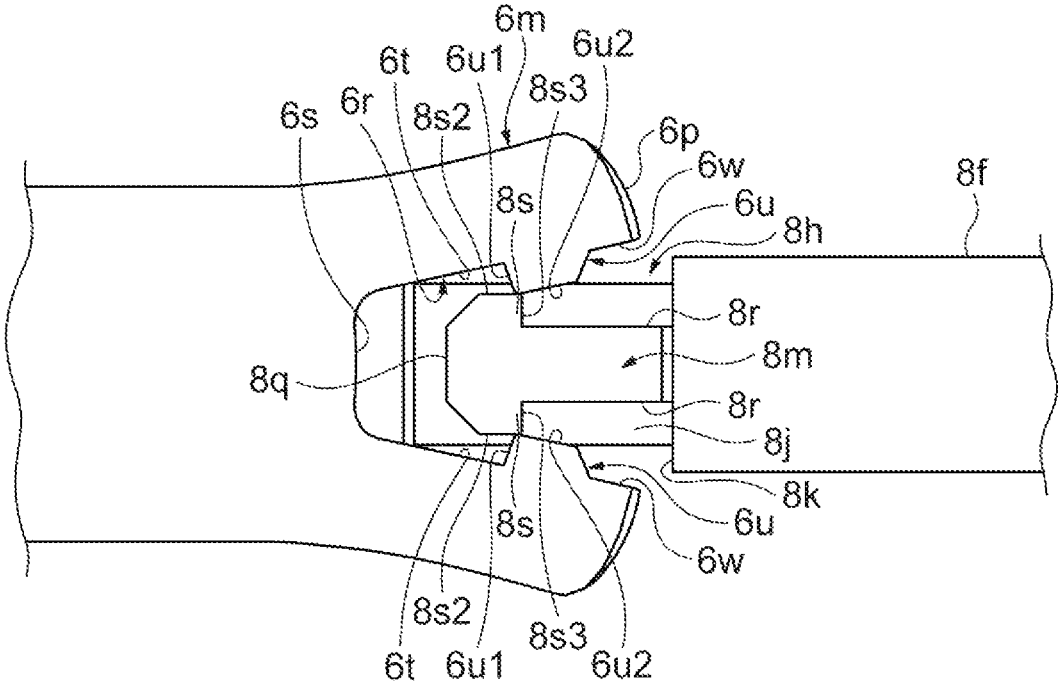
FIG. 24 is an enlarged side view of main portions of the cartridge and the slider illustrated in FIG. 23A.

FIG. 23A is a side view of the cartridge 10A and the slider 8A, illustrating a state where the cartridge 10A is further tilted from the slider 8A illustrated in FIG. 22A, and FIG. 23B is a side view of the cartridge 10A and the slider 8A as viewed from a direction different from the direction of FIG. 23A. FIG. 24 is an enlarged side view of main portions of the cartridge 10A and the slider 8A. When the cartridge 10A is tilted further relative to the slider 8A, the pair of raised portions 6*u* of the slit 6*r* press against the outer peripheral surface 8*j* of the insertion portion 8*h*, and accordingly a reaction force is applied to the pair of raised portions 6*u* from the outer peripheral surface 8*j*.

This reaction force causes the tubular portion 6*m* to elastically deform and expand outward in the radial direction. Accordingly, the pair of raised portions 6*u* move away from the pair of side surfaces 8*r* of the projection 8*m* while being in contact with the outer peripheral surface 8*j*. Then, the front end surface 6*u*1 of each of the raised portions 6*u* is shifted from the position opposing the rear end surface 8*s*3 of a corresponding one of the raised portions 8*s*, and the raised portion 6*u* climbs over the corresponding raised portion 8*s* and forward. This releases the engagement in the axial direction of the projection 8*m* and the slit 6*r*. Thereafter, the elastic deformation of the tubular portion 6*m* inward in the radial direction causes the tubular portion 6*m* that has been expanded to elastically return to the original shape.

Figure 25A:
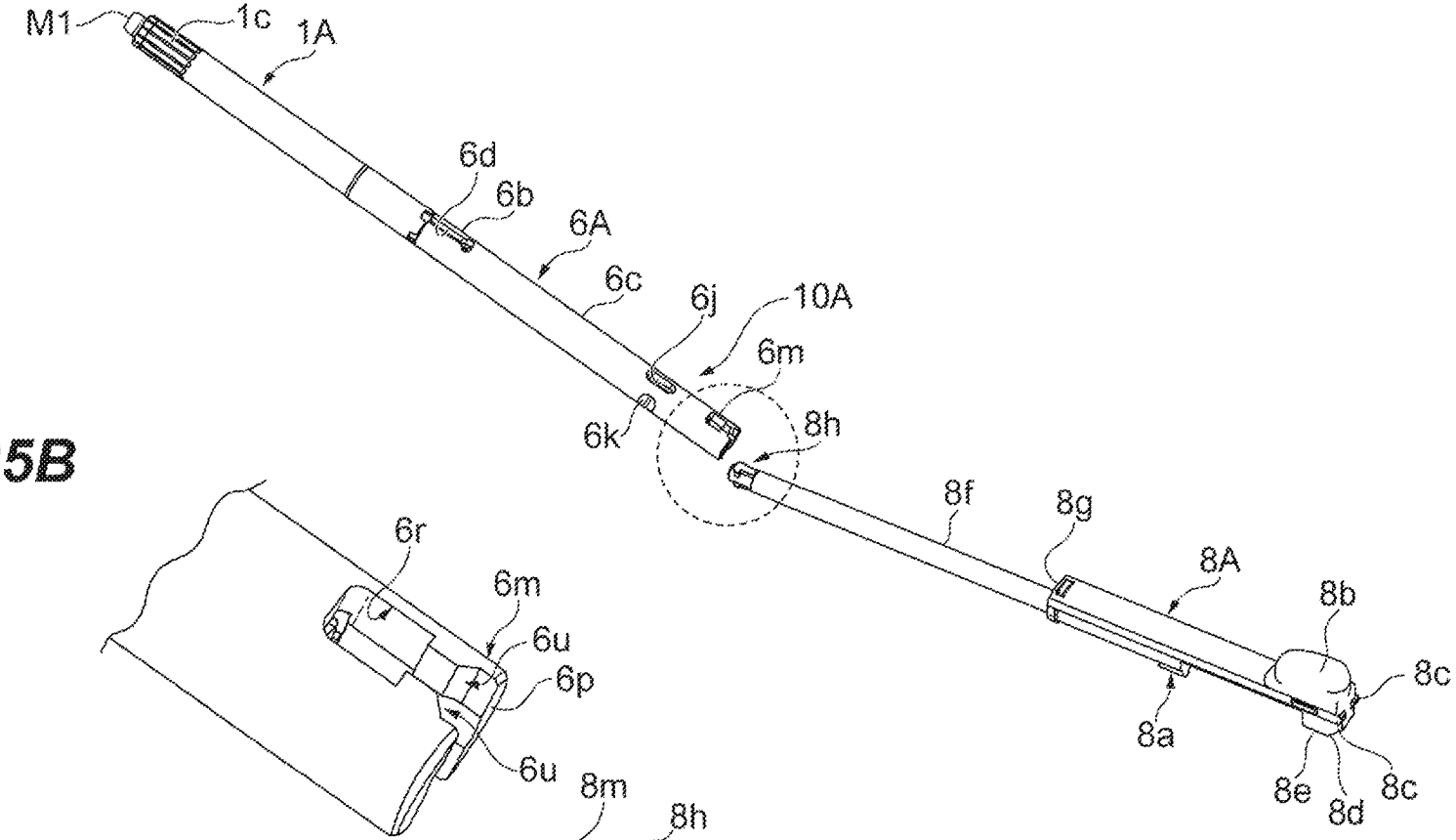
FIG. 25A is a perspective view of the cartridge and the slider, where the cartridge is detached from the slider.
Figure 25B:
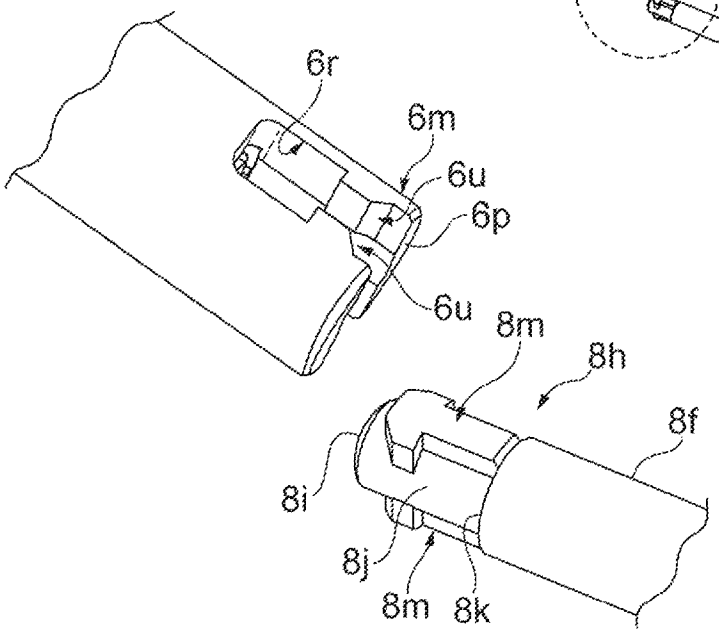
FIG. 25B is an enlarged perspective view of main portions of the cartridge and the slider illustrated in FIG. 25A.

FIG. 25A is a perspective view of the cartridge 10A and the slider 8A, illustrating a state where the cartridge 10A is detached from the slider 8A, and FIG. 25B is an enlarged perspective view of main portions of the cartridge 10A and the slider 8A, (e.g. a portion enclosed by the dashed line in FIG. 25A). When the cartridge 10A is moved away from the slider 8A in the state illustrated in FIG. 24, the tubular portion 6*m* is separated from the insertion portion 8*h*, and the cartridge 10A is detached from the slider 8A.

Figure 26A:
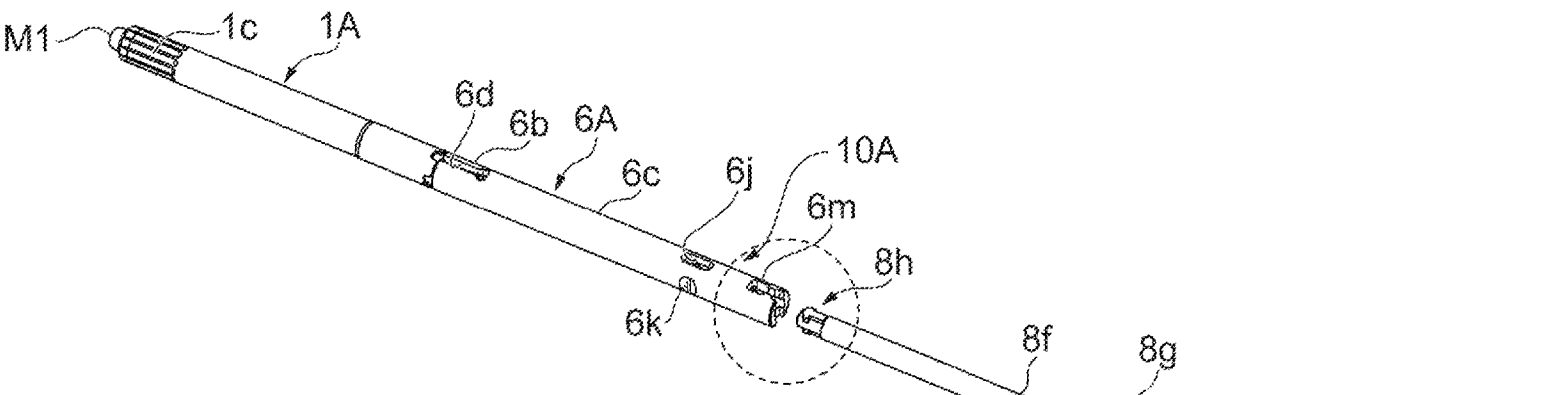
FIG. 26A is a perspective view of the cartridge and the slider, before the cartridge is attached to the slider.
Figure 26B:
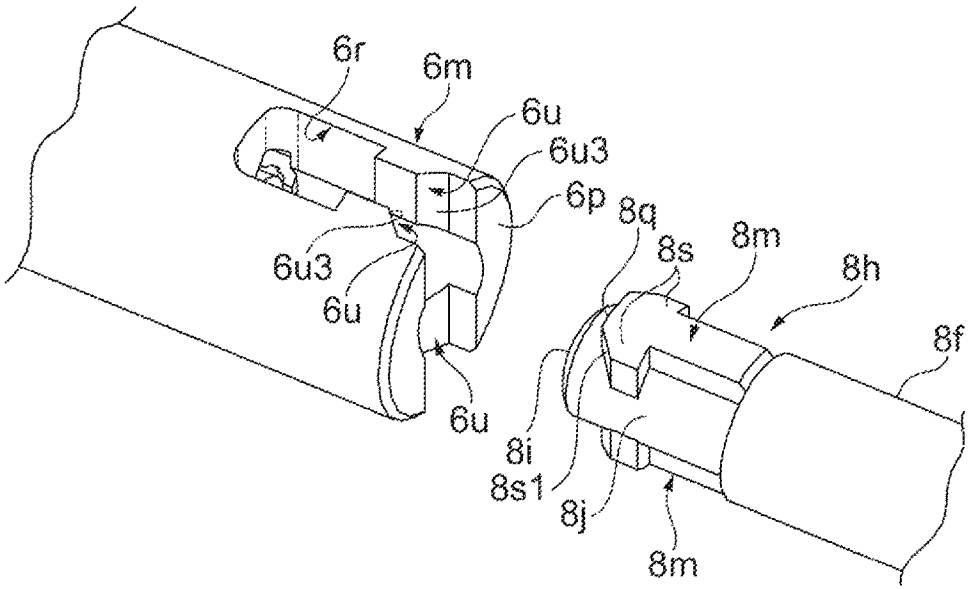
FIG. 26B is an enlarged perspective view of the main portions of the cartridge and the slider of FIG. 26A.

An example operation of attaching the cartridge 10 to the slider 8 is described below. FIG. 26A is a perspective view of the cartridge 10A and the slider 8A, illustrating a state before the cartridge 10A is attached to the slider 8A, and FIG. 26B is an enlarged perspective view of main portions of the cartridge 10A and the slider 8A, (e.g. a portion enclosed by the dashed line in FIG. 26A). When the cartridge 10A is attached to the slider 8A, the cartridge 10A is disposed adjacent the slider 8A in the axial direction to align the slit 6*r* with the projection 8*m* in the circumferential direction. Thereafter, the insertion portion 8*h* is inserted into the tubular portion 6*m* from the rear.

When the insertion portion 8*h* is inserted into the tubular portion 6*m*, the projection 8*m* is inserted into the slit 6*r* from the rear. Accordingly, the tapered surface 6*u*3 of each of the raised portions 6*u* comes into contact with the tapered surface 8*s*1 of a corresponding one of the raised portions 8*s*. When the tapered surface 6*u*3 comes into contact with the tapered surface 8*s*1, a reaction force is applied to the tapered surface 6*u*3 from the tapered surface 8*s*1. This reaction force causes the tubular portion 6*m* to elastically deform and expand the slit 6*r*. At this time, the tapered surface 6*u*3 slides upward along the tapered surface 8*s*1 with the tapered surface 6*u*3 in contact with the tapered surface 8*s*1.

Figure 27A:
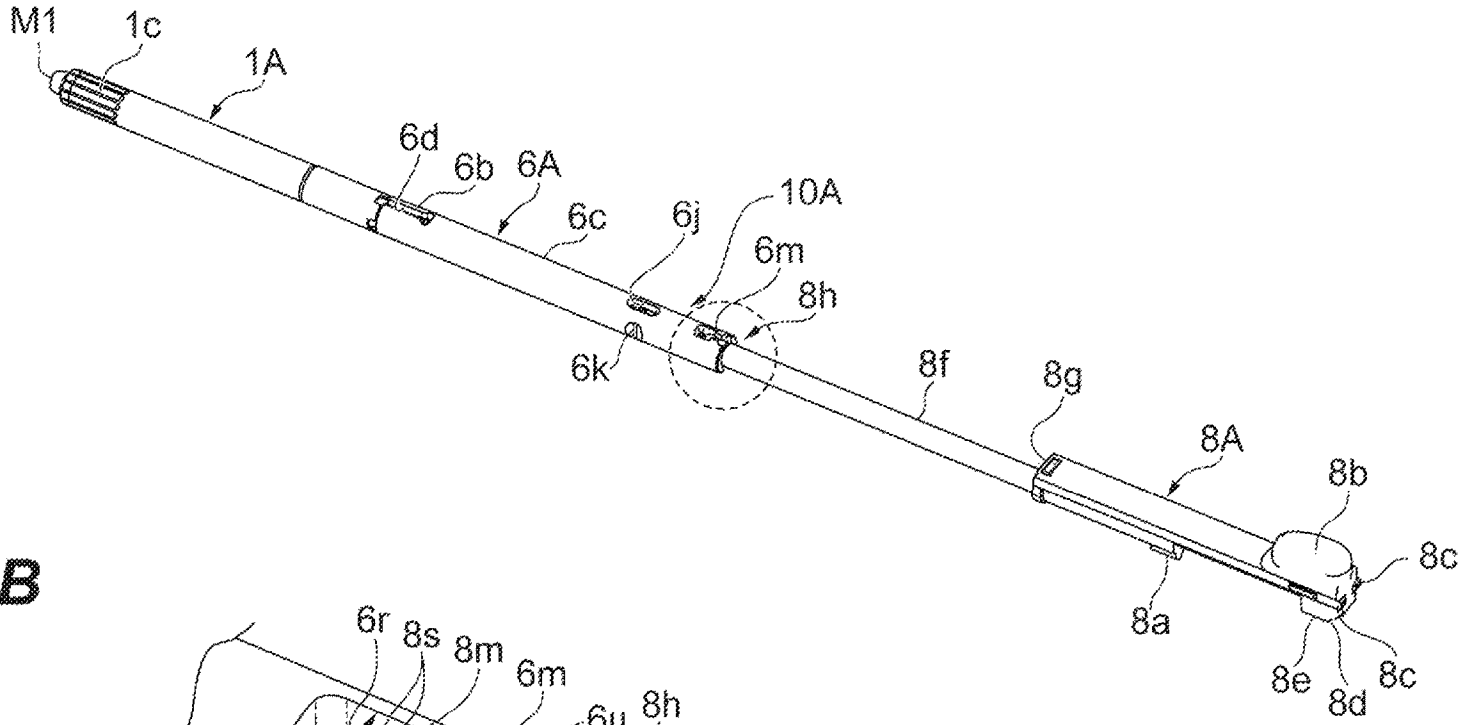
FIG. 27A is a perspective view of the cartridge and the slider, where the cartridge is attached to the slider.
Figure 27B:
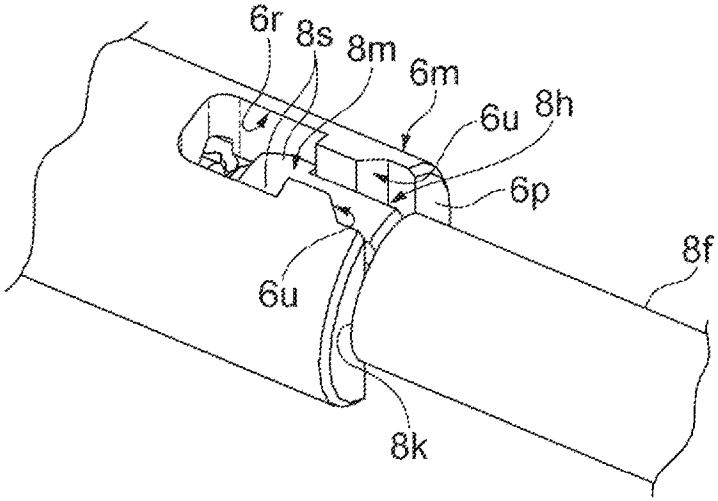
FIG. 27B is an enlarged perspective view of main portions of the cartridge and the slider of FIG. 27A.

FIG. 27A is a perspective view of the cartridge 10A and the slider 8A, illustrating a state where the cartridge 10A is attached to the slider 8A, and FIG. 27B is an enlarged perspective view of main portions of the cartridge 10A and the slider 8A (e.g. a portion enclosed by the dashed line in FIG. 27A). After each of the raised portions 6*u* of the slit 6*r* climbs over a corresponding one of raised portions 8*s* of the projection 8*m* rearward, the elastic deformation of the tubular portion 6*m* inward in the radial direction causes the tubular portion 6*m* to elastically return to the original shape, thereby causing each of the raised portions 6*u* of the slit 6*r* that has been expanded to return to the original position. This causes the slit 6*r* and the projection 8*m* to engage with each other in the axial direction. In some examples, each of the raised portions 8*s* of the projection 8*m* enters a space in front of a corresponding one of the raised portions 6*u* of the slit 6*r* and is brought into a state where the raised portion 8*s* is caught in the raised portion 6*u* in the axial direction so that the cartridge 10A is attached to the slider 8A.

Example operations for detaching the cartridge 10A from the main body 4 (e.g. slider 8A) and for attaching the cartridge 10A to the main body 4 have been described above. For each of the other cartridges such as the cartridges 10B and 10C, detachment from and attachment to the main body 4 may be made by the same or similar operations.

In an example feeding pencil 100, the engagement in the axial direction between the slit 6*r* of the tubular portion 6*m* and the projection 8*m* of the insertion portion 8*h* is released when the cartridge 10 is tilted from the slider 8. This action of release or disengagement allows the cartridge 10 to detach from the slider 8. Accordingly, the operation of tilting cartridge 10 relative to the slider 8 allows the cartridge 10 to detach from the slider 8 without rotating the cartridge 10, for example. This allows the cartridge 10 to be readily attached and detached from the slider 8, to facilitate manufacturing operations at the time of assembly of the feeding pencil 100.

When the cartridge 10 is tilted from the slider 8 with the front barrel 2 detached from the main body barrel 3 and the slider 8 moved forward by the fixed amount relative to the main body barrel 3, the engagement between the slit 6*r* of the tubular portion 6*m* and the projection 8*m* of the insertion portion 8*h* is released. In some examples, the cartridge 10 can be readily detached from the slider 8 with the front barrel 2 detached from the main body barrel 3 and the slider 8 moved forward by the fixed amount. Further, the cartridge 10 may be firmly or securely engaged with the slider 8 to prevent the cartridge 10 from inadvertently detaching from the slider 8 while in use.

In some examples, the front barrel 2 is engaged with the main body barrel 3 so as to be rotatable relative to the main body barrel 3. The slider 8 may be moved forward by the fixed amount relative to the main body barrel 3 to cause the pipe member 1 to engage with the front barrel 2 in the rotational direction. Additionally, the front barrel 2 and the main body barrel 3 may be relatively rotated in one direction with the pipe member 1 engaged with the front barrel 2 in the rotational direction, thereby causing the drawing material M to move forward in the front barrel 2. In some examples, when the slider 8 is moved forward by the fixed amount relative to the main body barrel 3, the pipe member 1 is moved forward accordingly. Then, with the pipe member 1 engaged with the front barrel 2 in the rotational direction, the relative rotation between the front barrel 2 and the main body barrel 3 in the one direction causes the drawing material M to move forward. In some examples, a structure in which the drawing material M is moved forward by the relative rotation between the front barrel 2 and the main body barrel 3 may exhibit the same or similar effects.

In some examples, the tubular portion 6*m* in which a slit 6*r* is formed is provided on the rear side of the cartridge 10 (for example, the rear end portion of the holder 6), and the insertion portion 8*h* including the projection 8*m* configured to be engaged with the slit 6*r* in the axial direction is provided on the front side of the main body 4 (e.g. the front end portion of the slider 8). The tubular portion 6*m* and the insertion portion 8*h* may be configure to facilitate an engagement between the cartridge 10 and the main body 4. When the tubular portion in which the slit is formed is provided on the front side of the main body rather than the cartridge 10, the cartridge may be detached by being tilted from the main body in which the slit is formed, which may decrease the mechanical strength of the main body due to repeated attachment and detachment. This in turn may decrease the strength of the engagement between the cartridge and the main body, or the integrity of the main body may be compromised. On the other hand, for examples in which the tubular portion 6*m* in which the slit 6*r* is formed is provided on the rear side of the cartridge 10, the mechanical strength of the main body 4 (insertion portion 8*h*) may be maintained despite repeated attachment and detachment.

When the cartridge 10 is tilted from the slider 8, the tubular portion 6*m* is separated from the insertion portion 8*h* while the outer peripheral surface 8*j* of the insertion portion 8*h* causes the tubular portion 6*m* to expand (see FIG. 24). Accordingly, the cartridge 10 may detach from the slider 8. In some examples, the insertion portion 8*h* can expand the slit 6*r*. Therefore, when the cartridge 10 is tilted from the slider 8, the tubular portion 6*m* is expanded by the outer peripheral surface 8*j* of the insertion portion 8*h*. This expansion causes the tubular portion 6*m* to separate from the insertion portion 8*h*, and accordingly causes the cartridge 10 to detach from the slider 8. The structure of the cartridge 10 and the slider 8 can be simplified.

In some examples, the insertion portion 8*h* has a cylindrical shape to prevent, when the cartridge 10 is detached from the slider 8 by being tilted from the slider 8, the pair of raised portions 6*u* of the tubular portion 6*m* from being caught in the outer peripheral surface 8*j* of the insertion portion 8*h*. Additionally, the cylindrical shape of the insertion portion 8*h* may facilitate the cartridge 10 to be more readily detachable and/or to maintain the mechanical strength of the insertion portion 8*h*.

In some examples, the projection 8*m* and the slit 6*r* are located on opposite sides of the tubular portion 6*m* from each other in the radial direction of the tubular portion 6*m*. This configuration allows the cartridge 10 to detach from the slider 8 by being tilted to not only one side in the radial direction but also the opposite side. This in turn allows the cartridge 10 to readily detach from the slider 8.

Providing the projection 8*m* and the slit 6*r* at three, four, five, or six or more positions in the circumferential direction may increase the number of directions in which the cartridge 10 is tilted to detach from the slider 8. On the other hand, as described above, providing the projection 8*m* and the slit 6*r* at two positions may maintain the mechanical strength of the tubular portion 6*m*.

It is to be understood that not all aspects, advantages and features described herein may necessarily be achieved by, or included in, any one particular example. Indeed, having described and illustrated various examples herein, it should be apparent that other examples may be modified in arrangement and detail. For example, the first engagement portion need not be the tubular portion 6*m*, and the second engagement portion need not be the insertion portion 8*h*.

In some examples, the tubular portion 6*m* is provided at the rear end portion of the holder 6, and the insertion portion 8*h* is provided at the front end portion of the slider 8. However, the insertion portion may be provided at the rear end portion of the holder, and the tubular portion may be provided at the front end portion of the slider. Further, insertion portion 8*h* may have a polygonal pillar shape such as a triangular pillar shape, a square pillar shape, a pentagonal pillar shape, or a hexagonal pillar shape.

Figure 28A:
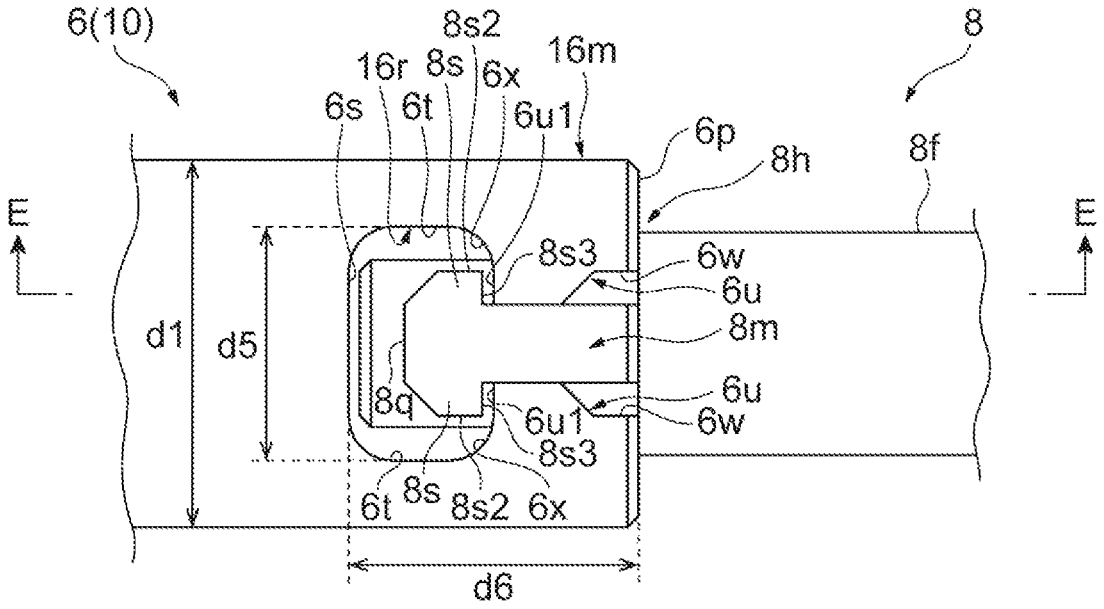
FIG. 28A is a side view of an example tubular portion with the insertion portion engaged with the tubular portion.
Figure 28B:
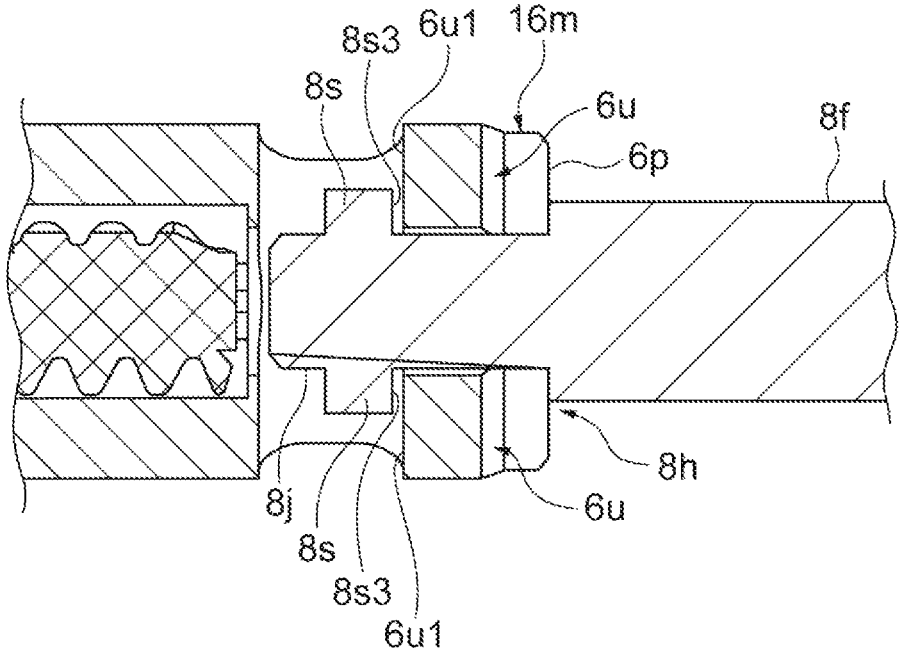
FIG. 28B is a cross-sectional view taken along line E-E of FIG. 28A.

FIG. 28A is a side view of an example tubular portion 16*m* and the insertion portion 8*h* in which the insertion portion 8*h* is engaged with the tubular portion 16*m* in the axial direction, and FIG. 28B is a cross-sectional view taken along line E-E of FIG. 28A. In the example tubular portion 16*m* of FIG. 28A, a front portion of a slit 16*r* is expanded as viewed from the radial direction, and accordingly the elasticity of the tubular portion 16*m* may be selectively adjusted. For example, the front portion of the slit 16*r* may be larger in width than a rear portion of the slit 16*r*.

A distance d5 between a pair of inner wall surfaces 6*t* of the slit 16*r* may be larger than the distance between a pair of inner wall surfaces 6*w*. In some examples, the inner wall surface 6*t* of the slit 16*r* is provided at a position distanced from the reference line extending in the axial direction through the center of the slit 16*r* as compared with the inner wall surface 6*w*. The distance d5 between the pair of inner wall surfaces 6*t* of the slit 16*r* is, for example, approximately 2.1 mm. The distance d5 is in a range of, for example, 40% to 80% of an outer diameter d1 of the tubular portion 16*m*. Further, the distance d5 is larger than the distance between the pair of top surfaces 8*s*2, and the inner wall surface 6*t* of the slit 16*r* opposes the top surface 8*s*2 of the raised portion 8*s* with a predetermined distance therebetween.

Located at a connecting portion between the front end surface 6*u*1 of the raised portion 6*u* and the inner wall surface 6*t* in the slit 16*r* is a curved surface 6*x* extending in a curved form in the axial direction and the circumferential direction. The curved surface 6*x* makes may be configured to suppress concentration of stress on a corresponding connecting portion between the inner wall surface 6*t* and the front end surface 6*u*1 when the tubular portion 16*m* is expanded. Further, in the slit 16*r*, a distance d6 in the axial direction between the inner wall surface 6*s* and the rear end surface 6*p* (i.e. a length in the axial direction of the slit 16*r*) may be smaller than the distance d2 between the inner wall surface 6*s* and the rear end surface 6*p*, for example. The distance d6 between the inner wall surface 6*s* and the rear end surface 6*p* is, for example, approximately 2.6 mm. The distance d6 is in a range of, for example, 50% to 100% of the outer diameter d1 of the tubular portion 16*m*.

Figure 29:
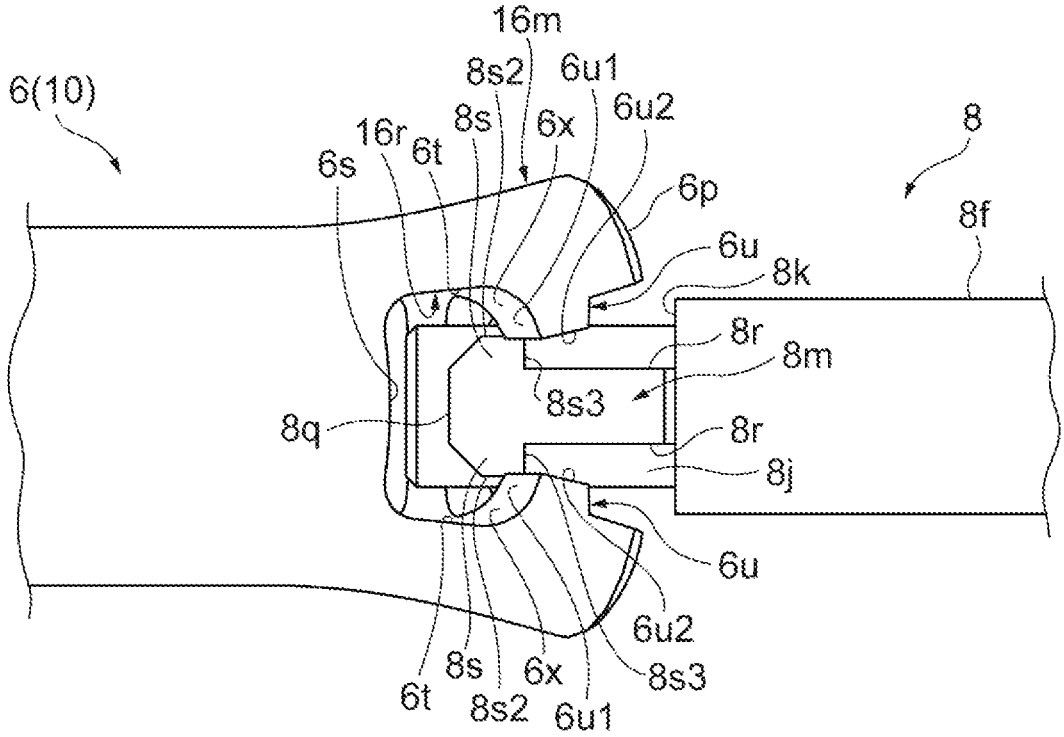
FIG. 29 is a side view of the cartridge and the slider, where the cartridge is tilted from the slider of FIG. 28A.

FIG. 29 is a side view of the cartridge 10 and the slider 8, illustrating a state where the cartridge 10 is tilted from the slider 8 of FIG. 28A. When the cartridge 10 is tilted from the slider 8, the pair of raised portions 6*u* of the slit 16*r* of the tubular portion 16*m* come into contact with the outer peripheral surface 8*j* of the insertion portion 8*h* and are pressed against the outer peripheral surface 8*j*. Then, a reaction force is applied to the pair of raised portions 6*u* from the outer peripheral surface 8*j* to cause the tubular portion 16*m* to elastically deform and expand outward in the radial direction. Accordingly, the amount (degree) of elastic deformation of the tubular portion 16*m* is selectively adjusted by a degree of expansion of the front portion of the slit 16*r*. Thereafter, the engagement between the projection 8*m* and the slit 16*r* in the axial direction may be released or detached.

Although the pair of slits 6*r* located on opposites sides from each other in the radial direction are provided symmetrically in the radial direction, the slits 6*r* may be provided asymmetrically. Further, the pair of raised portions 6*u* of the slit 6*r* may be provided asymmetrically in the circumferential direction. Still further, the pair of raised portions 8*s* of the projection 8*m* may be provided asymmetrically in the circumferential direction.

The projection 8*m* and the slit 6*r* may be located at positions other than the opposite sides of the insertion portion 8*h* and the cartridge 10A, respectively. For example, the projection 8*m* and the slit 6*r* may be provided at one position, and in some examples a different number and arrangement of the projections 8*m* and the slits 6*r* may be included. Further, the raised portion 6*u* and the raised portion 8*s* may have an arc shape as viewed from the radial direction. The raised portion 6*u* may include a vertical surface extending in the radial direction and the circumferential direction, rather than the tapered surface 6*u*3. Additionally, the raised portion 8*s* may include a vertical surface extending in the radial direction and the circumferential direction, rather than the tapered surface 8*s*1.

In some examples, the feeding pencil 100 includes the rotary push-out structure in which the drawing material M is moved forward by relative rotation between the front barrel 2 and the main body barrel 3. In other examples, the feeding pencil 100 may include a retractable push-out mechanism in which the drawing material M is moved forward by a retractable mechanism. When the cartridge 10 is detached from the slider 8 by being tilted from the slider 8, the slider 8 may be moved forward by the fixed amount relative to the main body barrel 3. In other examples, the slider 8 may not be moved forward by the fixed amount relative to the main body barrel 3. When the cartridge 10 is tilted from the slider 8 of the main body 4, the engagement in the axial direction between the tubular portion 6*m* and the insertion portion 8*h* is released. However, the engagement may instead be released when the cartridge 10 is tilted relative to another member of the main body 4 rather than the slider 8. In some examples, the engagement may be released when the cartridge 10 is tilted relative to the middle barrel provided in the main body 4.

In some examples, the annular raised portion 2*g*, the annular recessed portion 2*h* located in front of the annular raised portion 2*g*, and the annular recessed portion 2*j* located behind the annular raised portion 2*g* are provided on the inner surface of the front barrel 2. However, in some examples, either one of the annular recessed portion 2*h* or the annular recessed portion 2*j* may be omitted. For example, at least one of the front side of the annular raised portion 2*g* and the rear side of the annular raised portion 2*g* may be a flat surface.

In some examples, the projection 11*m* provided on the outer surface of the middle barrel 11 and the annular raised portion 2*g* provided on the inner surface of the front barrel 2 are detachably engaged with each other in the axial direction. However, in place of the projection 11*m* and the annular raised portion 2*g*, an annular raised portion and a projection may be formed on the outer surface of the middle barrel 11 and on the inner surface of the front barrel 2, respectively. Additionally, the annular raised portion on the outer surface of the middle barrel 11 and the projection on the inner surface of the front barrel 2 may be detachably engaged with each other in the axial direction.

As illustrated in FIG. 14A and FIG. 14B, the ridge 1*b* may be provided on the inner surface of the pipe member 1 in front of the female thread 1*a* and at four positions equally distanced from each other in the circumferential direction to prevent the drawing material M loaded in the pipe member 1 from coming off. However, the drawing material M may be prevented from coming off without the ridge 1*b*. For example, in place of the ridge 1*b*, a treatment for increasing a friction coefficient may be applied to the inner surface of the pipe member 1, or the inner surface of the pipe member 1 may have a noncircular shape such as a polygonal shape to prevent the drawing material M from coming off.

In some examples, the feeding pencil 100 may include drawing materials having different thicknesses from each other, or may include a plurality of drawing materials having different composition or use from each other. In some examples, the number of drawing materials may be two, three, four, five or more.

The feeding pencil may include a multi-color pencil. In some examples, the feeding pencil may include one drawing material and one cartridge. Further, the configuration of the cartridge need not include all of the components of the pipe member, the mobile body, and the holder, and some or all of the components may be replaced with different components, or, a different component may be added.

What is claimed is:

1. A feeding pencil comprising:

a main body including a main body barrel having a tubular shape;

a front barrel configured to be detachably engaged with the main body barrel; and a cartridge disposed in the front barrel for receiving a drawing material, wherein the cartridge includes a first engagement portion provided on a rear side of the cartridge, wherein the main body includes a second engagement portion provided on a front side of the main body and configured to be engaged with the first engagement portion, so that when the cartridge is tilted from the main body, an engagement between the first engagement portion and the second engagement portion is released, wherein the first engagement portion includes a tubular portion having a cutout hole formed through the tubular portion, and wherein the second engagement portion includes an insertion portion configured to be inserted into and engaged with the cutout hole of the tubular portion.

2. The feeding pencil according to claim 1, wherein the insertion portion has a cylindrical shape.

3. The feeding pencil according to claim 1, wherein a projection is formed on an outer surface of the insertion portion, wherein a raised portion is formed on an inner wall surface of the cutout hole, the projection being engaged with the raised portion, and wherein the projection and the raised portion are located on opposite sides of the tubular portion, in a radial direction of the tubular portion.

4. A feeding pencil comprising:

a main body including a main body barrel having a tubular shape;

a front barrel configured to be detachably engaged with the main body barrel; and a cartridge disposed in the front barrel for receiving a drawing material, wherein the cartridge includes a first engagement portion provided on a rear side of the cartridge, wherein the main body includes a second engagement portion provided on a front side of the main body and configured to be engaged with the first engagement portion, so that when the cartridge is tilted from the main body, an engagement between the first engagement portion and the second engagement portion is released, wherein the engagement of the first engagement portion and the second engagement portion includes a tubular portion having a cutout hole formed through the tubular portion, and an insertion portion configured to be inserted into and engaged with the cutout hole, and wherein, when the cartridge is tilted from the main body to cause the tubular portion to separate from the insertion portion while causing the insertion portion to expand the tubular portion, the cartridge is detached from the main body.

5. The feeding pencil according to claim 4, wherein the insertion portion has a cylindrical shape.

6. The feeding pencil according to claim 4, wherein a projection is formed on an outer surface of the insertion portion, wherein a raised portion is formed on an inner wall surface of the cutout hole, the projection being engaged with the raised portion, and wherein the projection and the raised portion are located on opposite sides of the tubular portion in a radial direction of the tubular portion.

7. A feeding pencil comprising:

a main body including a main body barrel having a tubular shape;

a front barrel configured to be detachably engaged with the main body barrel; and a cartridge disposed in the front barrel for receiving a drawing material, wherein the cartridge includes a first engagement portion provided on a rear side of the cartridge, wherein the main body includes a second engagement portion provided on a front side of the main body and configured to be engaged with the first engagement portion, so that when the cartridge is tilted from the main body, an engagement between the first engagement portion and the second engagement portion is released, wherein the main body further includes a slider provided in the main body barrel and wherein the slider is slidable by a fixed amount relative to the main body barrel, wherein the slider is disposed behind the cartridge, and wherein the second engagement portion is provided on a front side of the slider, so that when the cartridge is tilted from the slider in a state where the front barrel is detached from the main body barrel and where the slider is moved forward by the fixed amount relative to the main body barrel, the engagement between the first engagement portion and the second engagement portion is released.

8. The feeding pencil according to claim 7, wherein the engagement of the first engagement portion and the second engagement portion includes a tubular portion having a cutout hole formed through the tubular portion, and an insertion portion configured to be inserted into and engaged with the cutout hole.

9. The feeding pencil according to claim 8, wherein, when the cartridge is tilted from the main body to cause the tubular portion to separate from the insertion portion while causing the insertion portion to expand the tubular portion, the cartridge is detached from the main body.

10. The feeding pencil according to claim 8, wherein a projection is formed on an outer surface of the insertion portion, wherein a raised portion is formed on an inner wall surface of the cutout hole, the projection being engaged with the raised portion, and wherein the projection and the raised portion are located on opposite sides of the tubular portion in a radial direction of the tubular portion.

11. The feeding pencil according to claim 7, wherein the front barrel is engaged with the main body barrel and is rotatable relative to the main body barrel, wherein the cartridge includes:

a pipe member loaded with the drawing material;

a mobile body configured to push out the drawing material loaded in the pipe member forward; and a holder configured to hold the mobile body behind the pipe member, wherein the slider is moved forward by the fixed amount relative to the main body barrel, to cause the pipe member to engage with the front barrel in a rotational direction, and wherein, in a state where the pipe member is engaged with the front barrel in the rotational direction, a relative rotation between the front barrel and the main body barrel in one direction causes the drawing material to move forward in the front barrel.

12. The feeding pencil according to claim 11, wherein the engagement of the first engagement portion and the second engagement portion includes a tubular portion having a cutout hole formed through the tubular portion, and an insertion portion configured to be inserted into and engaged with the cutout hole.

13. The feeding pencil according to claim 12, wherein the first engagement portion comprises the tubular portion, and wherein the second engagement portion comprises the insertion portion.

14. The feeding pencil according to claim 12, wherein, when the cartridge is tilted from the main body to cause the tubular portion to separate from the insertion portion while causing the insertion portion to expand the tubular portion, the cartridge is detached from the main body.

15. The feeding pencil according to claim 12, wherein the insertion portion has a cylindrical shape.

16. The feeding pencil according to claim 12, wherein a projection is formed on an outer surface of the insertion portion, wherein a raised portion is formed on an inner wall surface of the cutout hole, the projection being engaged with the raised portion, and wherein the projection and the raised portion are located on opposite sides of the tubular portion in a radial direction of the tubular portion.

* * * * *